US010859931B2

(12) United States Patent
Hashimoto et al.

(10) Patent No.: US 10,859,931 B2
(45) Date of Patent: Dec. 8, 2020

(54) TONER AND TWO-COMPONENT DEVELOPER

(71) Applicant: CANON KABUSHIKI KAISHA, Tokyo (JP)

(72) Inventors: Takeshi Hashimoto, Moriya (JP); Kentaro Kamae, Kashiwa (JP); Kazuhisa Shirayama, Abiko (JP); Hayato Ida, Toride (JP); Takashi Matsui, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/438,541

(22) Filed: Jun. 12, 2019

(65) Prior Publication Data

US 2019/0384193 A1 Dec. 19, 2019

(30) Foreign Application Priority Data

Jun. 13, 2018 (JP) ..... 2018-113140
Apr. 10, 2019 (JP) ..... 2019-074932

(51) Int. Cl.

*G03G 9/08* (2006.01)
*G03G 9/087* (2006.01)
*G03G 9/097* (2006.01)
*G03G 9/107* (2006.01)

(52) U.S. Cl.

CPC ..... *G03G 9/08711* (2013.01); *G03G 9/0823* (2013.01); *G03G 9/08713* (2013.01); *G03G 9/08722* (2013.01); *G03G 9/08724* (2013.01); *G03G 9/08726* (2013.01); *G03G 9/08728* (2013.01); *G03G 9/08731* (2013.01); *G03G 9/08733* (2013.01); *G03G 9/08791* (2013.01); *G03G 9/08795* (2013.01); *G03G 9/08797* (2013.01); *G03G 9/09708* (2013.01); *G03G 9/09716* (2013.01); *G03G 9/09725* (2013.01); *G03G 9/107* (2013.01)

(58) Field of Classification Search

CPC ..... G03G 9/08711; G03G 9/107; G03G 9/09716; G03G 9/0823; G03G 9/09725; G03G 9/09708; G03G 9/08795; G03G 9/08797; G03G 9/08791; G03G 9/08733; G03G 9/08726; G03G 9/08724; G03G 9/08728; G03G 9/08731; G03G 9/08722; G03G 9/08713

USPC ..... 430/108.1, 109.1, 109.3, 109.31

See application file for complete search history.

(56) References Cited

U.S. PATENT DOCUMENTS 4,557,991 A * 12/1985 Takagiwa ..... G03G 9/08708 430/108.8
7,678,523 B2 3/2010 Hiroko et al.
7,842,446 B2 11/2010 Yanase et al.
7,923,190 B2 4/2011 Magome et al.
7,935,467 B2 5/2011 Dojo et al.
8,084,174 B2 12/2011 Hasegawa et al.
8,323,726 B2 12/2012 Naka et al.
8,426,091 B2 4/2013 Magome et al.
8,426,094 B2 4/2013 Magome et al.
8,614,044 B2 12/2013 Matsui et al.
8,778,585 B2 7/2014 Matsui et al.
8,841,054 B2 9/2014 Dojo et al.
8,883,389 B2 11/2014 Matsui et al.
8,921,023 B2 12/2014 Baba et al.
8,927,188 B2 1/2015 Naka et al.
8,974,994 B2 3/2015 Kamae et al.
8,986,914 B2 3/2015 Fujikawa et al.
9,057,970 B2 6/2015 Ida et al.
9,058,924 B2 6/2015 Komatsu et al.
9,063,443 B2 6/2015 Ishigami et al.
9,097,997 B2 8/2015 Nomura et al.
9,152,088 B1 10/2015 Kobori et al.
9,213,250 B2 12/2015 Nomura et al.
9,217,943 B2 12/2015 Matsui et al.
9,239,528 B2 1/2016 Hasegawa et al.

(Continued)

FOREIGN PATENT DOCUMENTS

EP 0 703 505 3/1996
EP 0 744 668 11/1996

(Continued)

OTHER PUBLICATIONS

Fedors, "A Method for Estimating Both the Solubility Parameters and Molar Volumes of Liquids", Polymer Engineering and Science, vol. 14, No. 2 (1974) 147-54.
Fedors, "A Method for Estimating Both the Solubility Parameters and Molar Volume of Liquids", Polymer Engineering and Science, vol. 14, No. 2 (1974) 147-54.
U.S. Appl. No. 16/203,864, filed Nov. 29, 2018, Takeshi Ohtsu.
U.S. Appl. No. 16/438,537, filed Jun. 12, 2019, Kentaro Kamae.
U.S. Appl. No. 16/438,544, filed Jun. 12, 2019, Kazuhisa Shirayama.
U.S. Appl. No. 16/438,545, filed Jun. 12, 2019, Kenta Kamikura.
U.S. Appl. No. 16/438,553, filed Jun. 12, 2019, Kenji Aoki.

(Continued)

*Primary Examiner* — Mark A Chapman
(74) *Attorney, Agent, or Firm* — Venable LLP

(57) ABSTRACT

A toner having an inorganic fine particle and a toner particle containing a binder resin, wherein the binder resin contains a polymer A having a first monomer unit derived from a first polymerizable monomer and a second monomer unit derived from a second polymerizable monomer that is different from the first polymerizable monomer, the first polymerizable monomer is selected from the (meth)acrylic acid esters each having a $C_{18-36}$ alkyl group, the content of the first monomer unit in the polymer A is within a specific range, the SP value of the first monomer unit and the SP value of the second monomer unit are in a specific relationship to one another, the inorganic fine particle is surface treated with a compound having an alkyl group, and the volume resistivity of the inorganic fine particle is within a specific range.

4 Claims, No Drawings

(56) References Cited

U.S. PATENT DOCUMENTS

| | | | | |
|---|---|---|---|---|
| 9,304,422 | B2 | 4/2016 | Matsui et al. | |
| 9,348,246 | B2 | 5/2016 | Magome et al. | |
| 9,348,247 | B2 | 5/2016 | Ida et al. | |
| 9,348,253 | B2 | 5/2016 | Kanno et al. | |
| 9,354,545 | B2 | 5/2016 | Matsui et al. | |
| 9,417,540 | B2 | 8/2016 | Hashimoto et al. | |
| 9,436,112 | B2 | 9/2016 | Iwasaki et al. | |
| 9,442,416 | B2 | 9/2016 | Magome et al. | |
| 9,442,419 | B2 | 9/2016 | Wakabayashi et al. | |
| 9,540,483 | B2 | 1/2017 | Ida et al. | |
| 9,581,934 | B2 | 2/2017 | Ito et al. | |
| 9,651,883 | B2 | 5/2017 | Hama et al. | |
| 9,658,546 | B2 | 5/2017 | Tanaka et al. | |
| 9,665,023 | B2 | 5/2017 | Kamae et al. | |
| 9,696,644 | B2 | 7/2017 | Ida et al. | |
| 9,857,707 | B2 | 1/2018 | Tsuda et al. | |
| 9,897,934 | B2 | 2/2018 | Tamura et al. | |
| 9,904,195 | B2 | 2/2018 | Matsui et al. | |
| 9,915,885 | B2 | 3/2018 | Katsumata et al. | |
| 9,969,834 | B2 | 5/2018 | Ohtsu et al. | |
| 10,012,918 | B2 | 7/2018 | Ishigami et al. | |
| 10,012,919 | B2 | 7/2018 | Matsui et al. | |
| 10,012,920 | B2 | 7/2018 | Shibata et al. | |
| 10,012,921 | B2 | 7/2018 | Kamae et al. | |
| 10,036,970 | B2 | 7/2018 | Kanno et al. | |
| 10,078,281 | B2 | 9/2018 | Ida et al. | |
| 10,082,743 | B2 | 9/2018 | Hama et al. | |
| 10,088,765 | B2 | 10/2018 | Miyakai et al. | |
| 10,133,201 | B2 | 11/2018 | Kamae et al. | |
| 10,146,146 | B2 | 12/2018 | Komatsu et al. | |
| 10,156,800 | B2 | 12/2018 | Tsuda et al. | |
| 10,175,595 | B2 | 1/2019 | Onozaki et al. | |
| 10,197,934 | B2 | 2/2019 | Matsui et al. | |
| 10,197,936 | B2 | 2/2019 | Onozaki et al. | |
| 10,203,619 | B2 | 2/2019 | Yamashita et al. | |
| 10,216,108 | B2 | 2/2019 | Iwasaki et al. | |
| 10,228,629 | B2 | 3/2019 | Tamura et al. | |
| 10,234,777 | B2 | 3/2019 | Ohtsu et al. | |
| 10,241,430 | B2 | 3/2019 | Kimura et al. | |
| 10,274,851 | B2 | 4/2019 | Hashimoto et al. | |
| 10,353,312 | B2 | 7/2019 | Kamae et al. | |
| 10,401,748 | B2 | 9/2019 | Hashimoto et al. | |
| 2002/0055050 | A1* | 5/2002 | Serizawa | G03G 9/09791 430/108.4 |
| 2004/0185367 | A1 | 9/2004 | Serizawa et al. | |
| 2007/0166636 | A1* | 7/2007 | Daimon | G03G 9/0825 430/109.3 |
| 2009/0087768 | A1 | 4/2009 | Tosaka et al. | |
| 2009/0197192 | A1 | 8/2009 | Hiroko et al. | |
| 2013/0108955 | A1 | 5/2013 | Shibata et al. | |
| 2013/0244159 | A1 | 9/2013 | Ishigami et al. | |
| 2013/0288173 | A1 | 10/2013 | Hashimoto et al. | |
| 2014/0038098 | A1 | 2/2014 | Naka et al. | |
| 2014/0134535 | A1 | 5/2014 | Baba et al. | |
| 2014/0272699 | A1 | 9/2014 | Minaki et al. | |
| 2014/0308611 | A1 | 10/2014 | Shimano et al. | |
| 2014/0329176 | A1 | 11/2014 | Kanno et al. | |
| 2015/0086917 | A1* | 3/2015 | Iwasaki | G03G 9/09716 430/106.1 |
| 2015/0099227 | A1 | 4/2015 | Ida et al. | |
| 2015/0185658 | A1 | 7/2015 | Wakabayashi et al. | |
| 2017/0045834 | A1 | 2/2017 | Shirai et al. | |
| 2017/0090324 | A1* | 3/2017 | Kadonome | G03G 9/0819 |
| 2017/0269496 | A1 | 9/2017 | Kubo et al. | |
| 2017/0315463 | A1 | 11/2017 | Onozaki et al. | |
| 2018/0143557 | A1 | 5/2018 | Ueda et al. | |
| 2018/0259867 | A1 | 9/2018 | Sano et al. | |
| 2018/0275540 | A1 | 9/2018 | Matsuo et al. | |
| 2018/0314176 | A1 | 11/2018 | Ikeda et al. | |
| 2018/0356746 | A1* | 12/2018 | Hama | G03G 9/0827 |
| 2018/0364601 | A1 | 12/2018 | Onozaki et al. | |
| 2019/0107793 | A1 | 4/2019 | Tamura et al. | |
| 2019/0113858 | A1 | 4/2019 | Kamae et al. | |
| 2019/0171125 | A1 | 6/2019 | Kanno et al. | |

FOREIGN PATENT DOCUMENTS

| | | |
|---|---|---|
| EP | 1 494 087 | 1/2005 |
| EP | 2 626 745 | 8/2013 |
| EP | 2 843 473 | 3/2015 |
| JP | 2000-250264 | 9/2000 |
| JP | 2011-094137 | 5/2011 |
| JP | 2013-228724 | 11/2013 |
| JP | 2014-130243 | 7/2014 |
| JP | 2014-222259 | 11/2014 |
| JP | 2017-058604 | 3/2017 |

OTHER PUBLICATIONS

U.S. Appl. No. 16/438,566, filed Jun. 12, 2019, Takashi Matsui.
U.S. Appl. No. 16/438,605, filed Jun. 12, 2019, Daisuke Yoshiba.
U.S. Appl. No. 16/438,611, filed Jun. 12, 2019, Hiroki Kagawa.
U.S. Appl. No. 16/438,623, filed Jun. 12, 2019, Tatsuya Saeki.
U.S. Appl. No. 16/532,887, filed Aug. 6, 2019, Ryuji Murayama.
U.S. Appl. No. 16/534,343, filed Aug. 7, 2019, Kentaro Kamae.
U.S. Appl. No. 16/550,410, filed Aug. 26, 2019, Masayuki Hama.

* cited by examiner

TONER AND TWO-COMPONENT DEVELOPER

BACKGROUND OF THE INVENTION

Field of the Invention

The present invention relates to a toner for use in electrophotographic systems, electrostatic recording systems, electrostatic printing systems and toner jet systems, and a two-component developer using the toner.

Description of the Related Art

As electrophotographic full color copiers have proliferated in recent years, there has been increased demand for higher printer speeds and greater energy savings. To achieve high-speed printing, techniques have been studied for melting the toner more rapidly in the fixing step. Techniques have also been studied for reducing the various control times within jobs and between jobs in order to increase productivity. As strategies for saving energy, techniques have been studied for fixing the toner at a lower temperature in order to reduce the energy expenditure in the fixing step.

Methods for achieving high-speed printing while improving the low-temperature fixability of the toner including lowering the glass transition point or softening point of the binder resin in the toner, and using a binder resin having a sharp-melt property. In recent years, many toners have been proposed that contain crystalline polyesters as resins having sharp-melt properties. However, crystalline polyesters have problems of charging stability in high-temperature, high-humidity environments, and particularly problems with maintaining charging performance after standing in high-temperature, high humidity environments.

Various toners have also been proposed that use crystalline vinyl resins as other crystalline resins having sharp-melt properties.

For example, Japanese Patent Application Publication No. 2014-130243 proposes a toner that achieves both low-temperature fixability and heat-resistant storage stability by using an acrylate resin having crystallinity in the side chains.

Japanese Patent Application Publication No. 2017-58604 proposes a toner using a binder resin comprising an amorphous vinyl resin chemically linked to a crystalline vinyl resin.

SUMMARY OF THE INVENTION

The toners of these patent documents can provide both low-temperature fixability and heat-resistant storage stability, as well as some improvement in charging stability, which has been a weakness of toners using crystalline polyester resins. However, it has been found that these toners using crystalline vinyl resins as binder resins have slow charge rising.

Because of this, it has been found that when an image with a small print percentage is printed immediately after printing an image with a large print percentage, the image density changes gradually due to the difference between the charge quantities of the toner present in the developing device and the new toner supplied to the developing device. This tendency is particularly evident in low-humidity environments.

The present invention provides a toner that resolves these problems. Specifically, it provides a toner that achieves both low-temperature fixability and heat-resistant storage stability, has charging stability even in high-temperature, high-humidity environments, and has rapid charge rising and is unlikely to cause density changes regardless of the image print percentage.

A first embodiment of the present invention is a toner, including:

an inorganic fine particle; and a toner particle containing a binder resin, wherein the binder resin contains a polymer A including a first monomer unit derived from a first polymerizable monomer and a second monomer unit derived from a second polymerizable monomer that is different from the first polymerizable monomer;

the first polymerizable monomer is at least one selected from the group consisting of (meth)acrylic acid esters each having a $C_{18-36}$ alkyl group;

the content of the first monomer unit in the polymer A is 5.0 mol % to 60.0 mol % of the total moles of all monomer units in the polymer A;

the content of the second monomer unit in the polymer A is 20.0 mol % to 95.0 mol % of the total moles of all monomer units in the polymer A;

when the SP value of the first monomer unit is $SP_{11}$ $(J/cm^3)^{0.5}$ and the SP value of the second monomer unit is $SP_{21}$ $(J/cm^3)^{05}$, formulae (1) and (2):

$$3.00 \leq (SP_{21} - SP_{11}) \leq 25.00 \quad (1)$$

$$21.00 \leq SP_{21} \quad (2)$$

are satisfied;

the inorganic fine particle is surface treated with a compound having an alkyl group; and the volume resistivity of the inorganic fine particle is $1.0 \times 10^5$ Ω·cm to $1.0 \times 10^{13}$ Ω·cm.

A second embodiment of the present invention is a toner having an inorganic fine particle and a toner particle containing a binder resin, wherein the binder resin contains a polymer A that is a polymer derived from a composition containing a first polymerizable monomer and a second polymerizable monomer that is different from the first polymerizable monomer;

the first polymerizable monomer is at least one selected from the group consisting of (meth)acrylic acid esters each having a $C_{18-36}$ alkyl group;

the content of the first polymerizable monomer in the composition is 5.0 mol % to 60.0 mol % of the total moles of all polymerizable monomers in the composition;

the content of the second polymerizable monomer in the composition is 20.0 mol % to 95.0 mol % of the total moles of all polymerizable monomers in the composition;

when the SP value of the first polymerizable monomer is $SP_{12}$ $(J/cm^3)^{0.5}$ and the SP value of the second polymerizable monomer is $SP_{22}$ $(J/cm^3)^{0.5}$, formulae (3) and (4):

$$0.60 \leq (SP_{22} - SP_{12}) \leq 15.00 \quad (3)$$

$$18.30 \leq SP_{22} \quad (4)$$

are satisfied;

the inorganic fine particle is surface treated with a compound having an alkyl group; and the volume resistivity of the inorganic fine particle is $1.0 \times 10^5$ Ω·cm to $1.0 \times 10^{13}$ Ω·cm.

The toner of the present invention achieves both low-temperature fixability and heat-resistant storage stability, has charging stability even in high-temperature, high-humidity environments, and has rapid charge rising and is unlikely to cause density changes regardless of the image print percentage.

Further features of the present invention will become apparent from the following description of exemplary embodiments.

DESCRIPTION OF THE EMBODIMENTS

Unless otherwise specified, descriptions of numerical ranges such as "from X to Y" or "X to Y" in the present invention include the numbers at the upper and lower limits of the range.

In the present invention, a (meth)acrylic acid ester means an acrylic acid ester and/or a methacrylic acid ester.

In the present invention, a "monomer unit" means a reacted form of a monomer substance in a polymer, and one carbon-carbon bonded section in a principal chain composed of polymerized vinyl monomers in a polymer is considered as one unit.

A vinyl monomer can be represented by the following formula (Z):

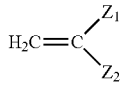

(Z)

[in formula (Z), $Z_1$ represents a hydrogen atom or an alkyl group (preferably a $C_{1-3}$ alkyl group, or more preferably a methyl group), and $Z_2$ represents an optional substituent].

A crystalline resin is a resin that exhibits a clear endothermic peak in differential scanning calorimetry (DSC).

The first embodiment of the present invention is a toner having an inorganic fine particle and a toner particle containing a binder resin, wherein the binder resin contains a polymer A having a first monomer unit derived from a first polymerizable monomer and a second monomer unit derived from a second polymerizable monomer that is different from the first polymerizable monomer, the first polymerizable monomer is at least one selected from the group consisting of (meth)acrylic acid esters each having a $C_{18-36}$ alkyl group, the content of the first monomer unit in the polymer A is 5.0 mol % to 60.0 mol % of the total moles of all monomer units in the polymer A, the content of the second monomer unit in the polymer A is 20.0 mol % to 95.0 mol % of the total moles of all monomer units in the polymer A, and assuming that an SP value of the first monomer unit is taken as $SP_{11}$ $(J/cm^3)^{0.5}$ and an SP value of the second monomer unit is taken as $SP_{21}$ $(J/cm^3)^{0.5}$, formulas (1) and (2):

$$3.00 \leq (SP_{21} - SP_{11}) \leq 25.00 \quad (1)$$

$$21.00 \leq SP_{21} \quad (2)$$

are satisfied;

the inorganic fine particle is surface treated with a compound having an alkyl group, and the volume resistivity of the inorganic fine particle is $1.0 \times 10^5$ Ω·cm to $1.0 \times 10^{13}$ Ω·cm.

The second embodiment of the present invention is a toner, including an inorganic fine particle; and a toner particle containing a binder resin, wherein the binder resin contains a polymer A that is a polymer derived from a composition containing a first polymerizable monomer and a second polymerizable monomer that is different from the first polymerizable monomer;

the first polymerizable monomer is at least one selected from the group consisting of (meth)acrylic acid esters each having a $C_{18-36}$ alkyl group;

the content of the first polymerizable monomer in the composition is 5.0 mol % to 60.0 mol % of the total moles of all polymerizable monomers in the composition;

the content of the second polymerizable monomer in the composition is 20.0 mol % to 95.0 mol % of the total moles of all polymerizable monomers in the composition;

assuming that an SP value of the first polymerizable monomer is taken as $SP_{12}$ $(J/cm^3)^{0.5}$ and an SP value of the second polymerizable monomer is taken as $SP_{22}$ $(J/cm^3)^{0.5}$, formulae (3) and (4):

$$0.60 \leq (SP_{22} - SP_{12}) \leq 15.00 \quad (3)$$

$$18.30 \leq SP_{22} \quad (4)$$

are satisfied;

the inorganic fine particle is surface treated with a compound having an alkyl group; and the volume resistivity of the inorganic fine particle is $1.0 \times 10^5$ Ω·cm to $1.0 \times 10^{13}$ Ω·cm.

The inventors believe that the mechanism that produces the effects of the invention is as follows.

It is thought that the charge rising speed of the toner is determined by the speed with which charge migrates to the toner particle surface from inorganic fine particles on the toner particle surface, and is saturated across the entire toner particle. Conventionally, low-resistivity inorganic fine particles such as titanium oxide have been used to increase the rate of charge transfer from the interior of the inorganic fine particle and thereby increase the charge rising speed of the toner.

However, the inventors' researches have shown that this by itself does not increase the charge rising speed sufficiently when a crystalline vinyl resin is used as the binder resin. This is thought to be because charge transfer from the inorganic fine particle to the toner particle surface is restricted.

As a result of studies into changing the composition of the binder resin, we discovered that charge rising can be improved somewhat by including a monomer unit with a high SP value in a crystalline vinyl resin. It is thought that when the SP value is high, charge transfer is more rapid due to the presence of electric dipoles due to charge localization. However, low-temperature fixability and heat-resistant storage stability may decline depending on the composition.

The inventors arrived at the present invention after discovering as a result of exhaustive research that these problems could be resolved by controlling the molar ratios, SP values and SP value difference of monomer units derived from multiple polymerizable monomers in the binder resin in the toner, as well as the resistivity and surface treatment of an inorganic fine particle on the toner particle surface.

The binder resin contains a polymer A having a first monomer unit derived from a first polymerizable monomer that is at least one selected from the group consisting of (meth)acrylic acid esters each having a $C_{18-36}$ alkyl group.

The binder resin has crystallinity and low-temperature fixability is improved if the first monomer unit is a (meth) acrylic acid ester having a $C_{18-36}$ alkyl group.

In the first embodiment, the content of the first monomer unit in the polymer A is 5.0 mol % to 60.0 mol % of the total moles of all monomer units in the polymer A.

In the second embodiment, the polymer A is a polymer derived from a composition containing a first polymerizable monomer and a second polymerizable monomer that is different from the first polymerizable monomer. The content of the first polymerizable monomer in the composition is 5.0 mol % to 60.0 mol % of the total moles of all polymerizable monomers in the composition.

A content within this range produces good low-temperature fixability and good charge rising in low-humidity environments. If the content is less than 5.0 mol %, low-temperature fixability is reduced. If the content exceeds 60.0 mol %, on the other hand, charge rising in low-humidity environments is reduced because more of the polymer is occupied by non-polar parts with low SP values. The content is more preferably 10.0 mol % to 60.0 mol %, or still more preferably 20.0 mol % to 40.0 mol %.

The first polymerizable monomer forming the first monomer unit is at least one selected from the group consisting of the (meth)acrylic acid esters having $C_{18-36}$ alkyl groups.

Examples of (meth)acrylic acid esters each having a $C_{18-36}$ alkyl group include (meth)acrylic acid esters each having a $C_{18-36}$ straight-chain alkyl group [stearyl (meth) acrylate, nonadecyl (meth)acrylate, eicosyl (meth)acrylate, heneicosanyl (meth)acrylate, behenyl (meth)acrylate, lignoceryl (meth)acrylate, ceryl (meth)acrylate, octacosyl (meth) acrylate, myricyl (meth)acrylate, dotriacontyl (meth)acrylate, etc.] and (meth)acrylic acid esters each having a $C_{18-36}$ branched alkyl group [2-decyltetradecyl (meth)acrylate, etc.].

Of these, at least one selected from the group consisting of the (meth)acrylic acid esters each having a $C_{18-36}$ straight-chain alkyl group is preferred from the standpoint of the storage stability of the toner. At least one selected from the group consisting of the (meth)acrylic acid esters each having a $C_{18-30}$ straight-chain alkyl group is more preferred, and at least one selected from the group consisting of straight-chain stearyl (meth)acrylate and behenyl (meth)acrylate is still more preferred.

One kind of monomer alone or a combination of two or more kinds may be used as the first polymerizable monomer.

In the first embodiment, the polymer A has a second monomer unit derived from a second polymerizable monomer that is different from the first polymerizable monomer. Assuming that the SP value of the second monomer unit is taken as $SP_{21}$, the following formula (2) is satisfied. More preferably the following formula (2)' is satisfied, and still more preferably the following formula (2)" is satisfied.

$$21.00 \leq SP_{21} \quad (2)$$

$$21.00 \leq SP_{21} \leq 40.00 \quad (2)'$$

$$25.00 \leq SP_{21} \leq 30.00 \quad (2)''$$

In the second embodiment, assuming that the SP value of the second polymerizable monomer is taken as $SP_{22}$ $(J/cm^3)^{0.5}$, the following formula (4) is satisfied. More preferably the following formula (4)' is satisfied, and still more preferably the following formula (4)" is satisfied.

$$18.30 \leq SP_{22} \quad (4)$$

$$18.30 \leq SP_{22} \leq 30.00 \quad (4)'$$

$$21.00 \leq SP_{22} \leq 23.00 \quad (4)''$$

If the SP value of the second monomer unit or second polymerizable monomer is within this range, charge transfer from the low-resistivity inorganic fine particle is rapid, and the charge rising speed is increased.

The SP value here is an abbreviation for "solubility parameter", and is a value indicating solubility. The calculation methods are described below.

In the first embodiment, assuming that the SP value of the first monomer unit is taken as $SP_{11}$ $(J/cm^3)^{0.5}$ and the SP value of the second monomer unit is taken as $SP_{21}$ $(J/cm^3)^{0.5}$ as, formula (1) below is satisfied. Preferably formula (1)' below is satisfied, and more preferably formula (1)" is satisfied, and still more preferably formula (1)''' is satisfied.

In the second embodiment, assuming that the SP value of the first polymerizable monomer is taken as $SP_{12}$ $(J/cm^3)^{0.5}$ and the SP value of the second polymerizable monomer is taken as $SP_{22}$ $(J/cm^3)^{0.5}$, formula (3) below is satisfied. Preferably formula (3)' is satisfied, and more preferably formula (3)" is satisfied, and still more preferably formula (3)''' is satisfied.

$$3.00 \leq (SP_{21} - SP_{11}) \leq 25.00 \quad (1)$$

$$3.00 \leq (SP_{21} - SP_{11}) \leq 20.00 \quad (1)'$$

$$4.00 \leq (SP_{21} - SP_{11}) \leq 15.00 \quad (1)''$$

$$5.00 \leq (SP_{21} - SP_{11}) \leq 15.00 \quad (1)'''$$

$$0.60 \leq (SP_{22} - SP_{12}) \leq 15.00 \quad (3)$$

$$0.60 \leq (SP_{22} - SP_{12}) \leq 10.00 \quad (3)'$$

$$2.00 \leq (SP_{22} - SP_{12}) \leq 7.00 \quad (3)''$$

$$3.00 \leq (SP_{22} - SP_{12}) \leq 7.00 \quad (3)'''$$

SP values in the present invention are represented in units of $(J/m^3)^{0.5}$, but these can be converted to units of $(cal/cm^3)^{0.5}$ using the formula 1 $(cal/cm^3)^{0.5} = 2.045 \times 10^3$ $(J/m^3)^{0.5}$.

If the SP value difference above is satisfied, the crystallinity of the polymer A is not reduced, and the melting point can be maintained. It is thus possible to achieve both low-temperature fixability and heat-resistant storage stability.

The charge rising is also good due to the increased likelihood of interactions between the first monomer unit and the alkyl groups of the low-resistance inorganic fine particle and charge transfer from the low-resistance inorganic fine particle to the polar parts of the second monomer unit.

The mechanism for this is thought to be as follows.

Crystallinity is expressed when the first monomer unit is incorporated into the polymer A and the first monomer units aggregate together, but when other monomer units are incorporated they normally inhibit crystallization, making it more difficult for the polymer to express crystallinity. This tendency is particularly evident when the first monomer units and other monomer units bond randomly in a single molecule of the polymer.

In the present invention, however, it is thought that because the polymer is constituted using polymerizable monomers such that $SP_{22}-SP_{12}$ is within the range of formula (3) above, the first polymerizable monomer and second polymerizable monomer can bond continuously to a certain degree rather than bonding randomly during polymerization. This means that the first monomer units can aggregate together in the polymer A, so that even if other monomer units are incorporated the crystallinity can still be increased and the melting point can be maintained.

Furthermore, it is thought that if $SP_{21}-SP_{11}$ is within the range of formula (1) above, the first monomer unit and second monomer unit can form a clear phase separation state rather than blending together in the polymer A, so that crystallinity is not reduced and the melting point is maintained.

The polymer A preferably has crystalline segments containing the first monomer unit derived from the first polymerizable monomer. The polymer A also preferably has amorphous segments containing second monomer units derived from the second polymerizable monomer.

It is also thought that adhesiveness between the inorganic fine particle and the toner particle is improved because the first monomer units are continuously linked, and therefore interact more readily with the alkyl groups of the low-resistivity inorganic fine particle. Similarly, it is thought that the charge rising is improved because the second monomer units are continuously linked, and are therefore more likely to assume a configuration conducive to rapid charge transfer from the low-resistivity inorganic fine particle to the high SP value second monomer unit.

In the first embodiment, the content of the second monomer unit in the polymer A is 20.0 mol % to 95.0 mol % of the total moles of all monomer units in the polymer A.

In the second embodiment, moreover, the content of the second polymerizable monomer in the composition is 20.0 mol % to 95.0 mol % of the total moles of all polymerizable monomers in the composition.

If these contents are within these ranges, charge transfer from the low-resistance inorganic fine particle to the polar parts of the second monomer unit is likely to be rapid. From the standpoint of charge rising in low-humidity environments, the content is preferably 40.0 mol % to 95.0 mol %, or more preferably 40.0 mol % to 70.0 mol %.

Of those, among examples listed below, a polymerizable monomer satisfying formula (1) or (3) may be used as the second polymerizable monomer for forming the second monomer unit. One kind of monomer alone or a combination of two or more kinds may be used as the second polymerizable monomer.

Monomers having nitrile groups: for example, acrylonitrile, methacrylonitrile and the like.

Monomers having hydroxy groups: for example, 2-hydroxyethyl (meth)acrylate, 2-hydroxypropyl (meth)acrylate and the like.

Monomers having amido groups: for example, acrylamide and monomers obtained by reacting $C_{1-30}$ amines by known methods with $C_{2-30}$ carboxylic acids having ethylenically unsaturated bonds (acrylic acid, methacrylic acid, etc.).

Monomers having urethane groups: for example, monomers obtained by reacting $C_{2-22}$ alcohols having ethylenically unsaturated bonds (2-hydroxyethyl methacrylate, vinyl alcohol, etc.) by known methods with $C_{1-30}$ isocyanates [monoisocyanate compounds (benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethylphenyl isocyanate, 3,5-dimethylphenyl isocyanate and 2,6-dipropylphenyl isocyanate, etc.), aliphatic diisocyanate compounds (trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate and 2,4,4-trimethylhexamethylene diisocyanate, etc.), alicyclic diisocyanate compounds (1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate and hydrogenated tetramethylxylylene diisocyanate, etc.) and aromatic diisocyanate compounds (phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate and xylylene diisocyanate, etc.) and the like], and monomers obtained by reacting $C_{1-26}$ alcohols (methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol, erucyl alcohol, etc.) by known methods with $C_{2-30}$ isocyanates having ethylenically unsaturated bonds [2-isocyanatoethyl (meth)acrylate, 2-(0-[1'-methylpropylidenamino]carboxyamino) ethyl (meth) acrylate, 2-[(3,5-dimethylpyrazolyl)carbonylamino]ethyl (meth)acrylate and 1,1-(bis(meth)acryloyloxymethyl) ethyl isocyanate, etc.] and the like.

Monomers having urea groups: for example, monomers obtained by reacting $C_{3-22}$ amines [primary amines (normal butylamine, t-butylamine, propylamine, isopropylamine, etc.), secondary amines (di-normal ethylamine, di-normal propylamine, di-normal butylamine, etc.), aniline, cycloxylamines and the like] by known methods with $C_{2-30}$ isocyanates having ethylenically unsaturated bonds and the like.

Monomers having carboxyl groups: for example, methacrylic acid, acrylic acid, 2-carboxyethyl (meth)acrylate.

Of these, it is desirable to use a monomer having a nitrile, amide, urethane, hydroxy or urea group. More preferable is a monomer having an ethylenically unsaturated bond and at least one functional group selected from the group consisting of the nitrile, amide, urethane, hydroxy and urea groups. These monomers are desirable for further improving charge rising is further improved in low-humidity environments. Of these, a nitrile group has strong electron withdrawing properties and is particularly desirable for accelerating charge transfer.

The vinyl esters such as vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate and vinyl octylate can also be used by preference as the second polymerizable monomer.

Because vinyl esters are nonconjugated monomers and can easily maintain an appropriate degree of reactivity with the first polymerizable monomer, it is easier to improve the crystallinity of the polymer A and achieve both low-temperature fixability and heat-resistant storage stability.

The second polymerizable monomer preferably has an ethylenically unsaturated bond, and more preferably has one ethylenically unsaturated bond.

Moreover, the second polymerizable monomer is preferably at least one selected from the group consisting of the following formulae (A) and (B):

(A)

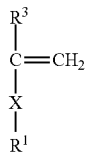

-continued (B)

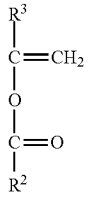

(In the formulae, X represents a single bond or $C_{1-6}$ alkylene group, and $R^1$ represents a nitrile group (—C≡N);

an amido group (—C(=O)NHR$^{10}$ (with $R^{10}$ being a hydrogen atom or $C_{1-4}$ alkyl group));

a hydroxy group;

—COOR$^1$ (with $R^{11}$ being a $C_{1-6}$ (preferably $C_{1-4}$) alkyl group or a $C_{1-6}$ (preferably $C_{1-4}$) hydroxyalkyl group);

a urethane group (—NHCOOR$^{12}$ (with $R^{12}$ being a $C_{1-4}$ alkyl group));

a urea group (—NH—C(=O)—N(R$^{13}$)$_2$ (in which $R^{13}$s are each independently a hydrogen atom or a $C_{1-6}$ (preferably $C_{1-4}$) alkyl group));

—COO(CH$_2$)$^2$NHCOOR$^{14}$ (with $R^{14}$ being a $C_{1-4}$ alkyl group), or

—COO(CH$_2$)$^2$—NH—C(=O)—N(R$^{15}$)$_2$ (in which $R^{15}$s are each independently a hydrogen atom or a $C_{1-6}$ (preferably $C_{1-4}$) alkyl group).

Preferably $R^1$ represents a nitrile group (—C≡N);

an amido group (—C(=O)NHR$^{10}$ (with $R^{10}$ being a hydrogen atom or $C_{1-4}$ alkyl group));

a hydroxy group;

—COOR$^1$ (with $R^{11}$ being a $C_{1-6}$ (preferably $C_{1-4}$) alkyl group or a $C_{1-6}$ (preferably $C_{1-4}$) hydroxyalkyl group);

a urea group (—NH—C(=O)—N(R$^{13}$)$_2$ (in which $R^{13}$s are each independently a hydrogen atom or a $C_{1-6}$ (preferably $C_{1-4}$) alkyl group));

—COO(CH$_2$)$^2$NHCOOR$^{14}$ (with $R^{14}$ being a $C_{1-4}$ alkyl group), or

—COO(CH$_2$)$^2$—NH—C(=O)—N(R$^{15}$)$_2$ (in which $R^{15}$s are each independently a hydrogen atom or a $C_{1-6}$ (preferably $C_{1-4}$) alkyl group).

$R^2$ is a $C_{1-4}$ alkyl group, and $R^3$s are each independently a hydrogen atom or methyl group.)

One kind of the second polymerizable monomer may be used alone, or two or more kinds may be combined.

When multiple kinds of monomer units fulfilling the conditions for the first monomer unit are present in the polymer A in the present invention, the value of $SP_{11}$ in the formula (1) is a weighted average of the SP values of each of these monomer units. For example, if the polymer contains a monomer unit A with an SP value of $SP_{111}$ in the amount of A mol % of the total moles of all monomer units fulfilling the conditions for the first monomer unit and a monomer unit B with an SP value of $SP_{112}$ in the amount of (100−A) mol % of the total moles of all monomer units fulfilling the conditions for the first monomer unit, the SP value ($SP_{11}$) becomes:

$$SP_{11}=(SP_{111}\times A+SP_{112}\times(100-A))/100.$$

The calculation is similar when three or more monomer units fulfilling the conditions for the first monomer unit are included. Similarly, $SP_{12}$ also represents an average value calculated based on the molar ratios of the respective first polymerizable monomers.

Moreover, the second monomer unit in the present invention corresponds to all monomer units having $SP_{21}$ values satisfying formula (1) in combination with the $SP_{11}$ value calculated by the methods described above. Similarly, the second polymerizable monomer corresponds to all polymerizable monomers having $SP_{22}$ values satisfying formula (3) in combination with the $SP_{12}$ value calculated by the methods described above.

That is, when the second polymerizable monomer is two or more kinds of polymerizable monomer, $SP_{21}$ represents the SP values of monomer units derived from each of the polymerizable monomers, and $SP_{21}-SP_{11}$ is determined for the monomer units derived from each of the second polymerizable monomers. Similarly, $SP_{22}$ represents the SP values of each of the polymerizable monomers, and $SP_{22}-SP_{12}$ is determined for each of the second polymerizable monomers.

The polymer A is preferably a vinyl polymer. The vinyl polymer may be a polymer of a monomer containing an ethylenically unsaturated bond for example. An ethylenically unsaturated bond is a radical polymerizable carbon-carbon double bond, and examples include vinyl, propenyl, acryloyl and methacryloyl groups and the like.

The acid value Av of the polymer A is preferably not more than 30.0 mg KOH/g, or more preferably not more than 20.0 mg KOH/g. There is no particular lower limit, but preferably it is at least 0 mg KOH/g. If the acid value is not more than 30.0 mg KOH/g, crystallization of the polymer A is not easily inhibited, and the melting is maintained well.

The weight-average molecular weight (Mw) of the tetrahydrofuran (THF)-soluble component of the polymer A as measured by gel permeation chromatography (GPC) is preferably from 10,000 to 200,000, or more preferably from 20,000 to 150,000. If the weight-average molecular weight (Mw) is within this range, it becomes easier to maintain elasticity near room temperature.

The melting point of the polymer A is preferably from 50° C. to 80° C., or more preferably from 53° C. to 70° C. If the melting point is not less than 50° C., heat-resistant storage stability is good, while if it is not more than 80° C., low-temperature fixability is improved.

The polymer A may also contain a third monomer unit derived from a third polymerizable monomer outside the scope of the formulae (1) and (3) (that is, different from the first polymerizable monomer and second polymerizable monomer) as long as the molar ratios of the first monomer unit derived from the first polymerizable monomer and the second monomer unit derived from the second polymerizable monomer described above are preserved.

Of the monomers mentioned as examples of the second polymerizable monomer, those that do not satisfy formula (1) or formula (3) above may be used as the third polymerizable monomer.

It is also possible to use the following monomers, which do not have nitrile, amide, urethane, hydroxy, urea or carboxyl groups: styrenes such as styrene and o-methylstyrene, and their derivatives, and (meth)acrylic acid esters such as methyl (meth)acrylate, n-butyl (meth)acrylate, t-butyl (meth)acrylate and 2-ethylhexyl (meth)acrylate.

The third polymerizable monomer is preferably at least one selected from the group consisting of styrene, methyl methacrylate and methyl acrylate.

When these monomers satisfy formula (1) or formula (3), they may be used as the second polymerizable monomer.

To more easily obtain the effects of the present invention, the content of the polymer A is preferably at least 50 mass % of the total mass of the binder resin. More preferably it is 80 mass % to 100 mass %, and still more preferably the binder resin is the polymer A.

To more easily obtain the effects of the present invention, it is also desirable for the polymer A to be present on the surface of the toner particle.

The binder resin may also contain a resin other than the polymer A as necessary for the purpose of improving pigment dispersibility or the like.

The following resins are examples of resins other than the polymer A that can be used in the binder resin: monopolymers of styrenes and substituted styrenes, such as poly-p-chlorostyrene and polyvinyl toluene; styrene copolymers such as styrene-p-chlorostyrene copolymer, styrene-vinyl toluene copolymer, styrene-vinyl naphthaline copolymer, styrene-acrylic acid ester copolymers, styrene-methacrylic acid ester copolymers, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyester resin, polyurethane resin, polyamide resin, furan resin, epoxy resin, xylene resin, polyvinyl butyral, terpene resin, coumarone-indene resin and petroleum-based resins.

Of these, a styrene copolymer or polyester resin is preferred. The resin is also preferably amorphous.

The toner of the invention is characterized by containing an inorganic fine particle with a volume resistivity of $1.0\times10^{5}$ Ω·cm to $1.0\times10^{13}$ Ω·cm.

If the volume resistivity of the inorganic fine particle is within this range, charge transfer within the inorganic fine particle occurs more rapidly, and charge rising is improved. If the volume resistivity is less than $1.0\times10^{5}$ Ω·cm, the charging properties are reduced in high-temperature, high-humidity environments because the resistivity is too low. If it exceeds $1.0\times10^{13}$ Ω·cm, on the other hand, charge rising is slow due to the high resistance. The volume resistivity of the inorganic fine particle is preferably $1.0\times10^{8}$ Ω·cm to $7.0\times10^{12}$ Ω·cm. The volume resistivity can be controlled by controlling the type of inorganic fine particle, the type of surface treatment, the concentration of the surface treatment agent and the like.

Examples of inorganic fine particles with volume resistivity values of $1.0\times10^{5}$ Ω·cm to $1.0\times10^{13}$ Ω·cm include titanate metal salts such as strontium titanate, calcium titanate and magnesium titanate, and metal oxides such as titanium oxide, magnesium oxide, zinc oxide and cerium oxide.

Of these, titanium oxide, strontium titanate, calcium titanate or zinc oxide is preferred, and strontium titanate is more preferred. With these, the properties such as particle diameter, resistivity, dielectric constant and the like can be controlled relatively easily by controlling the manufacturing conditions. The strontium titanate preferably has a perovskite crystal structure. If the strontium titanate has a perovskite crystal structure, charge transfer with the second monomer unit is accelerated.

Strontium titanate, calcium titanate and magnesium titanate fine particles can be obtained for example by an atmospheric heating reaction method. In this case, a mineral acid peptized product of a hydrolyzed titanium compound is used as the titanium oxide source, and a water-soluble acidic metal compound is used as the metal oxide source. Manufacturing can be performed by reacting a mixture of these while adding an alkaline aqueous solution at 60° C. or more, and then treating with an acid.

The method for manufacturing the titanium oxide fine particle is not particularly limited, and examples include titania particles produced by conventional sulfuric acid methods and chlorine methods, and titania particles produced by vapor-phase oxidation methods in which titanium tetrachloride as a raw material is reacted with oxygen in a vapor phase. A titania fine particle obtain by a sulfuric acid method is more preferred because it is easy to control the number-average particle diameter of the primary particles of the resulting titania fine particle.

For the titania fine particle, it is desirable to use either of two crystal forms, rutile and anatase. To obtain an anatase type titanium oxide fine particle, it is desirable to add phosphoric acid, a phosphate salt or a potassium salt or the like as a rutile transition inhibitor when baking metatitanic acid.

To obtain a rutile type titanium oxide fine particle, on the other hand, it is desirable to add a salt such as a lithium salt, magnesium salt, zinc salt or aluminum salt as a rutile transition promoter, or a seed such as a slurry containing rutile fine crystals.

Methods of manufacturing metal oxide fine particles of magnesium oxide, zinc oxide and cerium oxide include dry methods of oxidizing metal vapor in air to produce zinc oxide, and wet methods in which metal salts are neutralized by reacting then with alkali in aqueous solution, then water washed, dried, and baked to produce zinc oxide. Of these, synthesis by a wet method is preferred because it is more likely to yield a fine particle with a relatively small particle diameter that can be added to the toner surface.

The dielectric constant of the inorganic fine particle at 1 MHz is preferably 20 pF/m to 100 pF/m. An inorganic fine particle with a dielectric constant within this range is desirable because it undergoes rapid charge transfer with the second monomer unit. It is thought that because this dielectric constant derives from polarization within or between atoms, it is closely associated with charge transfer.

The dielectric constant can be controlled by selecting the inorganic fine particle, or by controlling the conditions and operations to alter the particle crystallinity when manufacturing the inorganic fine particle, such as by altering the reaction temperature or water pressure in a dry method or the pH or temperature in a wet method, or by ultrasound treatment, bubbling treatment or the like during crystal formation for example. The dielectric constant is more preferably 20 pF/m to 50 pF/m.

The inorganic fine particle is also characterized by being surface treated with a compound having an alkyl group.

If the inorganic fine particle has been surface treated with a compound having an alkyl group, it can improve adhesiveness by interacting with alkyl groups contained in the polymer A, and assume a configuration that facilitates rapid charge transfer from the inorganic fine particle to the second monomer unit of the toner particle.

Examples of compounds having alkyl groups include fatty acids, fatty acid metal salts, silicone oils, silane coupling agents, titanium coupling agents and fatty alcohols.

Of these, at least one compound selected from the group consisting of the fatty acids, fatty acid metal salts, silicone oils and silane coupling agents is preferred for easily obtaining the effects of the invention.

Examples of fatty acids and fatty acid metal salts include lauric acid, stearic acid, behenic acid, lithium laurate, lithium stearate, sodium stearate, zinc laurate, zinc stearate, calcium stearate and aluminum stearate.

The following are methods for surface treating the inorganic fine particle with a fatty acid or metal salt thereof. For example, a slurry containing the inorganic fine particle can be placed in fatty acid sodium aqueous solution in an Ar gas or $N_2$ gas atmosphere, and the fatty acid precipitated on the perovskite crystal surface. A slurry containing the inorganic fine particle can also be placed in a fatty acid sodium aqueous solution in an Ar gas or $N_2$ gas atmosphere, and an aqueous solution of a desired metal salt added dropwise under stirring to precipitate and adsorb a fatty acid metal salt on the perovskite crystal surface. For example, aluminum stearate can be adsorbed by using aluminum sulfate with a sodium stearate aqueous solution.

Examples of silicone oils include dimethyl silicone oil, methyl phenyl silicone oil, and alkyl modified silicone oils such as alpha-methylstyrene modified silicone oil and octyl modified silicone oil.

The method of silicone oil treatment may be a known method. For example, the inorganic fine particle and silicone oil can be mixed with a mixer; or the silicone oil can be sprayed with a sprayer onto the inorganic fine particle; or the silicone oil can be dissolved in a solvent, after which the inorganic fine particle is mixed in. The treatment method is not limited to these.

Examples of silane coupling agents include hexamethyl disilazane, trimethyl silane, trimethyl ethoxysilane, isobutyl trimethoxysilane, trimethyl chlorosilane, dimethyl dichlorosilane, methyl trichlorosilane, dimethyl ethoxysilane, dimethyl dimethoxysilane, octyl trimethoxysilane, decyl trimethoxysilane, cetyl trimethoxysilane and stearyl trimethoxysilane.

Examples of fatty alcohols include ethanol, n-propanol, 2-propanol, n-butanol, t-butanol, n-octanol, stearyl alcohol and 1-tetracosanol. The method of treatment with the fatty alcohol may be for example a method of treating the inorganic fine particle after heating and vaporizing at a temperature at or above the boiling point.

Of these compounds, at least one compound selected from the group consisting of the compounds having $C_{4-24}$ (preferably $C_{4-18}$) alkyl groups is desirable for improving the charge rising because it further improves interactions with the alkyl groups of the first monomer unit.

Assuming that the carbon number of the alkyl group of the first polymerizable monomer is taken as $C_x$ and the carbon number of the alkyl group of the compound having an alkyl group is taken as $C_y$, $C_x/C_y$ is preferably 0.8 to 24.0, or more preferably 1.0 to 10.0, because this strengthens the interactions between the alkyl groups. When using multiple polymerizable monomers or multiple compounds having alkyl groups, the carbon number is the average carbon number based on the molar ratios.

The number-average particle diameter of the primary particles of the inorganic fine particle is preferably 20 nm to 300 nm. A number-average primary particle diameter within this range is desirable because it makes it easier for the inorganic fine particles to interact with both the first and second monomer units of a polymer A having a block copolymer-like structure. 20 nm to 200 nm is more preferable.

The content of the inorganic fine particle is preferably from 0.1 to 10.0 mass parts per 100 mass parts of the toner particle.

The coverage ratio of the toner particle by the inorganic fine particle is preferably 3 area % to 80 area % to more easily obtain the effects of the invention. More preferably it is 10 area % to 80 area %, or still more preferably 20 area % to 80 area %. The coverage ratio can be controlled by controlling the added amount of the inorganic fine particle, the external addition conditions and the like.

The charge decay rate coefficient rate of the toner as measured in a 30° C., 80% RH environment is preferably 3 to 100, or more preferably 3 to 60. A charge decay rate coefficient within this range is desirable for controlling loss of charge in high-temperature, high-humidity environments. The charge decay rate coefficient can be controlled by controlling the type and acid value of the binder resin, the type of inorganic fine particle, the inorganic fine particle surface treatment agent, and the coverage ratio of the toner particle by the inorganic fine particle.

As discussed above, a strontium titanate fine particle can be obtained by an atmospheric heating reaction method.

Atmospheric Heating Reaction Method

A mineral acid peptized product of a hydrolyzed titanium compound is used as the titanium oxide source. For example, metatitanic acid with an $SO_3$ content of preferably not more than 1.0 mass % or more preferably not more than 0.5 mass % obtained by the sulfuric acid method that has been peptized by adjusting the pH to 0.8 to 1.5 with hydrochloric acid can be used.

A nitrate salt, hydrochloride salt or the like may be used as the strontium oxide source, and for example strontium nitrate or strontium hydrochloride may be used.

A caustic alkali may be used for the alkaline aqueous solution, and a sodium hydroxide aqueous solution is preferred.

Factors that affect the particle diameter of the resulting strontium titanate particle include the mixing ratios of the titanium oxide source and strontium oxide source in the reaction, the concentration of the titanium oxide source at the beginning of the reaction, and the temperature and addition rate when adding the alkaline aqueous solution, and these can be adjusted appropriately to obtain the target particle diameter and particle size distribution. It is desirable to prevent contamination by carbon dioxide gas during the reaction process by for example performing the reaction in a nitrogen gas atmosphere to prevent production of hydrochloride salts.

Factors that affect the dielectric constant of the resulting strontium titanate particle include conditions and operations that disrupt the particle crystallinity. To obtain a strontium titanate with a low dielectric constant, energy is preferably applied to disrupt crystal growth with the reaction solution at a high concentration, and one specific method is to apply microbubbling with nitrogen during the crystal growth process for example.

For the mixing ratios of the titanium oxide source and strontium oxide source during the reaction, the molar ratio of $SrO/TiO_2$ is preferably 0.9 to 1.4, or more preferably 1.05 to 1.20. If the $SrO/TiO_2$ molar ratio is not less than 0.9, there is less likely to be residual unreacted titanium oxide. The concentration of the titanium oxide source at the beginning of the reaction can be 0.05 to 1.3 mol/L, or more preferably 0.08 to 1.0 mol/L as $TiO_2$.

The temperature when adding the alkaline aqueous solution is preferably about 60° C. to 100° C. Regarding the addition rate of the alkaline aqueous solution, a slower addition rate produces a metal titanate particle with a larger particle diameter, and a faster addition rate produces a metal titanate particle with a smaller particle diameter. The addition rate of the alkaline aqueous solution is preferably 0.001 to 1.2 eq/h or more preferably 0.002 to 1.1 eq/h relative to the raw materials, and can be adjusted appropriately according to the desired particle diameter.

Acid Treatment

Preferably the metal titanate particle obtained by the atmospheric heating reaction is further acid treated. When synthesizing the metal titanate particle by an atmospheric heating reaction, if the mixing ratio of the titanium oxide source and strontium oxide source exceeds a $SrO/TiO_2$ molar ratio of 1.0, metal sources other than unreacted titanium remaining after completion of the reaction may react with carbon dioxide gas in the air, producing impurities such as metal carbonate salts. Consequently, acid treatment is preferably performed after addition of the alkaline aqueous solution to remove unreacted metal sources.

In the acid treatment, the pH is preferably adjusted to 2.5 to 7.0 or more preferably to 4.5 to 6.0 with hydrochloric acid. In addition to hydrochloric acid, nitric acid, acetic acid and the like may also be used as acids.

Colorant

The toner may also use a colorant. Examples of colorants include the following.

Examples of black colorants include carbon black and blacks obtained by blending yellow, magenta and cyan colorants. A pigment may be used alone as a colorant, but combining a dye and a pigment to improve the sharpness is desirable from the standpoint of the image quality of full-color images.

Examples of pigments for magenta toners include C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269 and 282; C.I. pigment violet 19; and C.I. vat red 1, 2, 10, 13, 15, 23, 29 and 35, Examples of dyes for magenta toners include C.I. solvent red 1, 3, 8, 23, 24, 25, 27, 30, 49, 81, 82, 83, 84, 100, 109 and 121; C.I. disper red 9; C.I. solvent violet 8, 13, 14, 21, 27; oil-soluble dyes such as C.I. disper violet 1, and C.I. basic red 1, 2, 9, 12, 13, 14, 15, 17, 18, 22, 23, 24, 27, 29, 32, 34, 35, 36, 37, 38, 39 and 40; and basic dyes such as C.I. basic violet 1, 3, 7, 10, 14, 15, 21, 25, 26, 27 and 28.

Examples of pigments for cyan toners include C.I. pigment blue 2, 3, 15:2, 15:3, 15:4, 16, and 17; C. I. vat blue 6; and C.I. acid blue 45 and copper phthalocyanine pigments having 1 to 5 phthalimidomethyl substituents in the phthalocyanine framework.

Examples of dyes for cyan toners include C.I. solvent blue 70.

Examples of pigments for yellow toners include C.I. pigment yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. vat yellow 1, 3 and 20. Examples of dyes for yellow toners include C.I. solvent yellow 162.

The content of the colorant is preferably from 0.1 to 30 mass parts per 100 mass parts of the binder resin.

Wax

A wax may also be used in the toner, Examples of the wax include the following: hydrocarbon waxes such as microcrystalline wax, paraffin wax and Fischer-Tropsch wax; oxides of hydrocarbon waxes, such as polyethylene oxide wax, and block copolymers of these; waxes such as carnauba wax consisting primarily of fatty acid esters; and waxes such as deoxidized carnauba wax consisting of partially or fully deoxidized fatty acid esters.

Other examples include the following: saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, ceryl alcohol and melissyl alcohol; fatty acid amides such as linoleamide, oleamide and lauramide; saturated fatty acid bisamides such as methylene bis stearamide, ethylene bis capramide, ethylene bis lauramide and hexamethylene bis stearamide; unsaturated fatty acid amides such as ethylene bis oleamide, hexamethylene bis oleamide, N,N'-dieoleyl adipamide and N,N'-dioleyl sebacamide; aromatic bisamides such as m-xylene bis stearamide and N,N'-distearyl isophthalamide; aliphatic metal salts (commonly called metal soaps) such as calcium stearate, calcium laurate, zinc stearate and magnesium stearate; waxes obtained by grafting vinyl monomers such as styrene and acrylic acid onto aliphatic hydrocarbon waxes; partial esterification products of polyhydric alcohols and fatty acids, such as behenic acid monoglyceride; and methyl ester compounds having hydroxy groups obtained by hydrogenation of plant-based oils and fats.

The content of the wax is preferably 2.0 to 30.0 mass parts per 100 mass parts of the binder resin.

Charge Control Agent

A charge control agent may also be included in the toner as necessary. A known charge control agent may be included in the toner, and a metal compound of an aromatic carboxylic acid is especially desirable because it is colorless and can provide a rapid charging speed and stably maintain a uniform charge quantity.

Examples of negative charge control agents include salicylic acid metal compounds, naphthoic acid metal compounds, dicarboxylic acid metal compounds, polymeric compounds having sulfonic acids or carboxylic acids in the side chains, polymeric compounds having sulfonic acid salts or sulfonic acid esters in the side chains, polymeric compounds having carboxylic acid salts or carboxylic acid esters in the side chains, and boron compounds, urea compounds, silicon compounds and calixarenes. The charge control agent may be added either internally or externally to the toner particle.

The added amount of the charge control agent is preferably 0.2 to 10 mass parts per 100 mass parts of the binder resin.

Inorganic Fine Power

In addition to the inorganic fine particle described above, another inorganic fine powder may be included in the toner as necessary. The inorganic fine powder may be added either internally or externally to the toner particle. An inorganic fine powder such as silica is desirable as an external additive. Preferably the inorganic fine powder is one that has been hydrophobically treated with a hydrophobic agent such as a silane compound or silicone oil or a mixture of these.

For example, it is desirable to use a silica fine powder produced by any method, such a precipitation method, sol-gel method or other wet method for obtaining silica by neutralizing sodium silicate, or a flame melting method, arc method or other dry method for obtaining silica in a vapor phase. Of these, a silica fine powder produced by a sol-gel method or flame melting method is more desirable because it makes it easier to control the number-average particle diameter of the primary particle within the desired range.

An inorganic fine powder with a specific surface area of from 50 $m^2/g$ to 400 $m^2/g$ is desirable as an external additive for improving flowability, while an inorganic fine powder with a specific surface area of from 10 $m^2/g$ to 50 $m^2/g$ is desirable for stabilizing durability. To both improve flowability and stabilize durability, inorganic fine particles with specific surface area within these ranges may be combined.

Developer

The toner may be used as a one-component developer, but from the standpoint of obtaining stable image quality in the long term, it is preferably mixed with a magnetic carrier and used as a two-component developer in order to improve dot reproducibility. That is, this is preferably a two-component developer containing a toner and a magnetic carrier, in which the toner is the toner of the present invention.

A common, well-known magnetic carrier may be used, and examples include surface oxidized iron powders, unoxidized iron powders, metal particles of iron, lithium, calcium, magnesium, nickel, copper, zinc, cobalt, manganese, chromium, rare earths and the like, alloy particles and oxide particles of these, magnetic bodies such as ferrite, and resin carriers with dispersed magnetic bodies (so-called resin carriers) comprising binders resins carrying these magnetic bodies in a dispersed state.

When the toner is mixed with a magnetic carrier and used as a two-component developer, good effects can normally be obtained if the carrier mixing ratio (toner concentration of the two-component developer) is from 2 mass % to 15 mass %, or more preferably from 4 mass % to 13 mass %.

Method for Manufacturing Toner Particle

The method for manufacturing the toner particle is not particularly limited, and a conventional known method such as suspension polymerization, emulsion aggregation, melt kneading or dissolution suspension may be used.

The resulting toner particle may be used as is as the toner. An inorganic fine particle or other external additive as necessary may also be mixed with the resulting toner particle to obtain a toner. Mixing of the toner particle with the inorganic fine particle and other external additive can be accomplished using a mixing apparatus such as a double cone mixer, V mixer, drum mixer, Super mixer, Henschel mixer, Nauta mixer, Mechano Hybrid (Nippon Coke and Engineering), Nobilta (Hosokawa Micron) or the like.

The external additive is preferably used in the amount of from 0.1 to 10.0 mass parts per 100 mass parts of the toner particle.

The methods for measuring the various physical properties of the toner and raw materials are explained below.

Analysis Methods

Measuring Volume Resistivity of Inorganic Fine Particle

The volume resistivity of the inorganic fine particle is measured as follows. A Keithley Instruments Model 6517 Electrometer/High Resistance System is used as the apparatus. Electrodes 25 mm in diameter are connected, inorganic fine particles are placed between the electrodes to a thickness of about 0.5 mm, and the distance between the electrodes is measured under about 2.0 N of load.

The resistance value is measured when 1,000 V of voltage has been applied to the inorganic fine particles for 1 minute, and volume resistivity is calculated according to the following formula.

$$\text{Volume resistivity } (\Omega\cdot\text{cm}) = R \times L$$

R: Resistance value (Ω)

L: Distance between electrodes (cm)

Separation of Inorganic Fine Particles from Toner

The inorganic fine particles can also be separated from the toner by the following methods and measured.

200 g of sucrose (Kishida Chemical) is added to 100 mL of ion-exchanged water, and dissolved in a hot water bath to prepare a concentrated sucrose solution. 31 g of the concentrated sucrose solution and 6 mL of Contaminon N (a 10 mass % aqueous solution of a pH 7 neutral detergent for washing precision instruments, comprising a nonionic surfactant, an anionic surfactant and an organic builder, manufactured by Wako Pure Chemical Industries, Ltd.) are added to a centrifugation tube to prepare a dispersion solution. 1 g of the toner is added to this dispersion solution, and clumps of toner are broken up with a spatula or the like.

The centrifugation tube is shaken for 20 minutes in the shaker at a rate of 350 passes per minute. After being shaken, the solution is transferred to a glass tube (50 mL) for a swing rotor, and centrifuged under conditions of 3,500 rpm, 30 minutes in a centrifuge. Toner is present in the uppermost layer inside the glass tube after centrifugation, while inorganic fine particles are present in the aqueous solution of the lower layer. The aqueous solution of the lower layer is collected and centrifuged to separate the sucrose from the inorganic fine particles, and the inorganic fine particles are collected. Centrifugation is repeated as necessary, and once the separation is sufficient, the dispersion is dried, and the inorganic fine particles are collected.

When multiple inorganic fine particles have been added, they can be selected by centrifugation or the like.

Measuring Dielectric Constant

Using a 284A Precision LCR Meter (Hewlett Packard), the complex dielectric constant is measured at a frequency of 1 MHz after calibration at frequencies of 1 kHz and 1 MHz. 39,200 kPa (400 kg/cm$^2$) of load is applied for 5 minutes to the inorganic fine particles to be measured, to mold a disc-shaped measurement sample 25 mm in diameter and not more than 1 mm thick (preferably 0.5 to 0.9 mm). This measurement sample is mounted on an ARES (Rheometric Scientific FE) equipped with a dielectric constant measurement jig (electrode) 25 mm in diameter, and measured at a frequency of 1 MHz under 0.49 N (50 g) of load in a 25° C. atmosphere.

Measuring Charge Decay Rate Coefficient of Toner

The charge decay rate coefficient of the toner was measured using an NS-D100 static diffusivity measurement device (Nano Seeds).

First, about 100 mg of toner is placed in a sample pan, and scraped to make the surface smooth. The sample pan is exposed for 30 seconds to X-rays with an X-ray static eliminator to remove the charge from the toner. The decharged sample pan is placed on a measurement plate. A metal plate is simultaneously mounted as a reference for zero correction of the surface voltometer. The measurement plate with the sample is left standing for 1 hour or longer in a 30° C., 80% RH environment prior to measurement.

The measurement conditions are set as follows.

Charge time: 0.1 sec

Measurement time: 1,800 sec

Measurement interval: 1 sec

Discharge polarity: −

Electrodes: Yes

The initial potential is set at −600 V, and the change in surface potential beginning immediately after charging is measured. The results are fitted into the following formula to determine the charge decay rate coefficient α.

$$V_t = V_0 \exp(-\alpha t^{1/2})$$

$V_t$: Surface potential (V) at time t $V_0$: Initial surface potential (V)

t: Time after charging (seconds)

α: Charge decay rate coefficient

Number-Average Particle Diameter of Primary Particles of Inorganic Fine Particle The number-average particle diameter of the primary particles of the inorganic fine particle is measured using an S-4800 Hitachi ultra-high resolution field emission scanning electron microscope (FE-SEM) (Hitachi High-Technologies).

Measurement is performed on the toner after the inorganic fine particle has been mixed in.

With the magnification set to 50,000, photographs are taken and further enlarged two times, the maximum diameter (major axis diameter) a and minimum diameter (minor axis diameter) b of the inorganic fine particles are measured from the resulting FE-SEM photographs, and (a+b)/2 is regarded as the particle diameter of these particles. The diameters of 100 randomly selected inorganic fine particles are measured, and the average is calculated and regarded as the number-average diameter of the primary particles of the inorganic fine particle.

Method for Measuring Content of Monomer Units Derived from Each Polymerizable Monomer in Polymer A The contents of the monomer units derived from each polymerizable monomer in the polymer A are measured by $^{1}$H-NMR under the following conditions.

Measurement unit: FT NMR unit JNM-EX400 (JEOL Ltd.)
Measurement frequency: 400 MHz
Pulse condition: 5.0 μs
Frequency range: 10,500 Hz
Number of integrations: 64
Measurement temperature: 30° C.
Sample: Prepared by placing 50 mg of the measurement sample in a sample tube with an inner diameter of 5 mm, adding deuterated chloroform ($CDCl_3$) as a solvent, and dissolving this in a thermostatic tank at 40° C.

Of the peaks attributable to constituent elements of the monomer unit derived from the first polymerizable monomer in the resulting $^{1}$H-NMR chart, a peak independent of peaks attributable to constituent elements of otherwise-derived monomer units is selected, and the integrated value $S_1$ of this peak is calculated. Similarly, a peak independent of peaks attributable to constituent elements of otherwise-derived monomer units is selected from the peaks attributable to constituent elements of the monomer unit derived from the second polymerizable monomer, and the integrated value $S_2$ of this peak is calculated.

When a third polymerizable monomer is used, a peak independent of peaks attributable to constituent elements of otherwise-derived monomer units is selected from the peaks attributable to constituent elements of the monomer unit derived from the third polymerizable monomer, and the integrated value $S_3$ of this peak is calculated.

The content of the monomer unit derived from the first polymerizable monomer is determined as follows using the integrated values $S_1$, $S_2$ and $S_3$. $n_1$, $n_2$ and $n_3$ are the numbers of hydrogen atoms in the constituent elements to which the observed peaks are attributed for each segment.

$$\text{Content (mol \%) of monomer unit derived from first polymerizable monomer}=\{(S_1/n_1)/((S_1/n_1)+(S_2/n_2)+(S_3/n_3))\}\times 100.$$

The monomer units derived from the second and third polymerizable monomers are determined similarly as shown below.

$$\text{Content (mol \%) of monomer unit derived from second polymerizable monomer}=\{(S_2/n_2)/((S_1/n_1)+(S_2/n_2)+(S_3/n_3))\}\times 100.$$

$$\text{Content (mol \%) of monomer unit derived from third polymerizable monomer}=\{(S_3/n_3)/((S_1/n_1)+(S_2/n_2)+(S_3/n_3))\}\times 100.$$

When a polymerizable monomer not containing a hydrogen atom in a constituent element other than a vinyl group is used in the polymer A, measurement is performed in single pulse mode using $^{13}$C-NMR with $^{13}$C as the measurement nucleus, and the ratio is calculated in the same way as by $^{1}$H-NMR.

When the toner is manufactured by suspension polymerization, independent peaks may not be observed because the peaks of release agents and other resins overlap. It may thus be impossible to calculate the ratios of the monomer units derived from each of the polymerizable monomers in the polymer A. In this case, a polymer A' can be manufactured and analyzed as the polymer A by performing similar suspension polymerization without using a release agent or other resin.

Method for Calculating SP Value $SP_{12}$ and $SP_{22}$ are determined as follows following the calculation methods proposed by Fedors.

The evaporation energy (Δei) (cal/mol) and molar volume (Δvi) ($cm^3$/mol) are determined from the tables described in "Polym. Eng. Sci., 14(2), 147-154 (1974)" for the atoms or atomic groups in the molecular structures of each of the polymerizable monomers, and $(4.184\times\Sigma\Delta ei/\Sigma\Delta vi)^{0.5}$ is regarded as the SP value $(J/cm^3)^{0.5}$.

$SP_{11}$ and $SP_{21}$ are calculated by similar methods for the atoms or atomic groups in the molecular structures of the same polymerizable monomers with the double bonds cleaved by polymerization.

Method for Measuring Melting Points

The melting points of the polymer A and release agent are measured under the following conditions using a DSC Q1000 (TA Instruments).

Ramp rate: 10° C./min
Measurement start temperature: 20° C.
Measurement end temperature: 180° C.

The melting points of indium and zinc are used for temperature correction of the device detection part, and the heat of fusion of indium is used for correction of the calorific value.

Specifically, 5 mg of sample is weighed precisely into an aluminum pan, and subjected to differential scanning calorimetry. An empty silver pan is used for reference.

The peak temperature of the maximum endothermic peak during the first temperature rise is regarded as the melting point.

When multiple peaks are present, the maximum endothermic peak is the peak at which the endothermic quantity is the greatest.

Measuring Molecular Weight of THF-soluble Component of Resin

The molecular weight (Mw) of the THF-soluble component of the polymer A is measured as follows by gel permeation chromatography (GPC).

First, the sample is dissolved in tetrahydrofuran (THF) over the course of 24 hours at room temperature. The resulting solution is filtered through a solvent-resistant membrane filter (Maishori Disk, Tosoh Corp.) having a pore diameter of 0.2 μm to obtain a sample solution. The concentration of THF-soluble components in the sample solution is adjusted to about 0.8 mass %. Measurement is performed under the following conditions using this sample solution.

System: HLC8120 GPC (detector: RI) (Tosoh Corp.)
Columns: Shodex KF-801, 802, 803, 804, 805, 806, 807 (total 7) (Showa Denko)
Eluent: Tetrahydrofuran (THF)
Flow rate: 1.0 mL/min
Oven temperature: 40.0° C.
Sample injection volume: 0.10 mL A molecular weight calibration curve prepared using standard polystyrene resin (product name: TSK standard polystyrene F-850, F-450, F-288, F-128, F-80, F-40, F-20, F-10, F-4, F-2, F-1, A-5000, A-2500, A-1000, A-500, Tosoh Corp.) is used for calculating the molecular weights of the samples.

Method for Measuring Acid Value

The acid value is the number of mg of potassium hydroxide needed to neutralize the acid contained in 1 g of sample. The acid value of the polymer A in the present invention is measured in accordance with JIS K 0070-1992, and the specific measurement procedures are as follows.

(1) Reagent Preparation

A phenolphthalein solution is obtained by dissolving 1.0 g of phenolphthalein in 90 mL of ethyl alcohol (95 vol %) and adding ion-exchanged water to a total of 100 mL.

7 g of special-grade potassium hydroxide is dissolved in 5 mL of water, and this is brought to 1 L by addition of ethyl alcohol (95 vol %). This is placed in an alkali-resistant container while avoiding contact with carbon dioxide and the like, allowed to stand for 3 days, and filtered to obtain a potassium hydroxide solution. The resulting potassium hydroxide solution is stored in an alkali-resistant container. The factor of this potassium hydroxide solution is determined from the amount of the potassium hydroxide solution required for neutralization when 25 mL of 0.1 mol/L hydrochloric acid is placed in an Erlenmeyer flask, several drops of the phenolphthalein solution are added, and titration is performed with the potassium hydroxide solution. The 0.1 mol/L hydrochloric acid is prepared in accordance with JIS K 8001-1998.

(2) Operations (A) Main Test 2.0 g of a pulverized sample of the polymer A is weighed exactly into a 200 mL Erlenmeyer flask, 100 mL of a toluene:ethanol (2:1) mixed solution is added, and the sample is dissolved over the course of 5 hours. Several drops of the phenolphthalein solution are then added as an indicator, and titration is performed using the potassium hydroxide solution. The titration endpoint is taken to be persistence of the faint pink color of the indicator for 30 seconds.

(B) Blank Test

Titration is performed by the same procedures, but without using any sample (that is, with only the toluene:ethanol (2:1) mixed solution).

(3) The Acid Value is Calculated by Substituting the Obtained Results into the Following Formula:

$$A=[(C-B)\times f\times 5.61]/S$$

where A is the acid value (mg KOH/g), B is the added amount (mL) of the potassium hydroxide solution in blank test, C is the added amount (mL) of the potassium hydroxide solution in main test, f is the factor of the potassium hydroxide solution, and S is the mass of the sample (g).

Method for Measuring Coverage Rate of External Additive

To determine the coverage ratio of the external additive, surface images of toner particles taken with an S-4800 Hitachi ultra-high resolution field emission scanning electron microscope (SEM, Hitachi High-Technologies) are analyzed with image analysis software (Image-Pro Plus ver. 5.0, Nippon Roper).

Inorganic fine particles present on the surface of the toner particles are observed with this SEM apparatus.

During observation, locations where the toner particle surface is smooth are selected as much as possible.

Binarization is performed on an image in which only the inorganic fine particles are extracted on the toner particle surface, and the ratio of the area occupied by the inorganic fine particles relative to the area of the toner particle surface is calculated. The same operations are performed on 10 toner particles, and the arithmetic mean is calculated.

Weight-Average Particle Diameter (D4) of Toner Particle

Using a Multisizer (registered trademark) 3 Coulter Counter precise particle size distribution analyzer (Beckman Coulter, Inc.) based on the pore electrical resistance method and equipped with a 100 μm aperture tube, together with the accessory dedicated Beckman Coulter Multisizer 3 Version 3.51 software (Beckman Coulter, Inc.) for setting measurement conditions and analyzing measurement data, measurement is performed with 25,000 effective measurement channels, and the measurement data are analyzed to calculate the weight-average particle diameter (D4) of the toner particle.

The aqueous electrolyte solution used in measurement may be a solution of special grade sodium chloride dissolved in ion-exchanged water to a concentration of about 1 mass %, such as ISOTON II (Beckman Coulter, Inc.) for example.

The dedicated software settings are performed as follows prior to measurement and analysis.

On the "Standard measurement method (SOM) changes" screen of the dedicated software, the total count number in control mode is set to 50,000 particles, the number of measurements to 1, and the Kd value to a value obtained with "standard particles 10.0 μm" (Beckman Coulter, Inc.). The threshold noise level is set automatically by pushing the "Threshold/Noise Level measurement button". The current is set to 1600 μA, the gain to 2, and the electrolyte solution to ISOTON II, and a check is entered for aperture tube flush after measurement.

On the "Conversion settings from pulse to particle diameter" screen of the dedicated software, the bin interval is set to the logarithmic particle diameter, the particle diameter bins to 256, and the particle diameter range to from 2 μm to 60 μm.

The specific measurement methods are as follows.

(1) About 200 mL of the aqueous electrolyte solution is added to a dedicated 250 mL round-bottomed beaker of the Multisizer 3, the beaker is set on the sample stand, and stirring is performed with a stirrer rod counter-clockwise at a rate of 24 rotations/second. Contamination and bubbles in the aperture tube are then removed by the "Aperture tube flush" function of the dedicated software.

(2) 30 mL of the same aqueous electrolyte solution is placed in a glass 100 mL flat-bottomed beaker, and about 0.3 mL of a dilution of "Contaminon N" (a 10 mass % aqueous solution of a pH 7 neutral detergent for washing precision instruments, comprising a nonionic surfactant, an anionic surfactant, and an organic builder, manufactured by Wako Pure Chemical Industries) diluted 3× by mass with ion-exchanged water is added.

(3) A specific amount of ion-exchanged water is placed in the water tank of an ultrasonic disperser (Ultrasonic Dispersion System Tetora 150, Nikkaki Bios) with an electrical output of 120 W equipped with two built-in oscillators having an oscillating frequency of 50 kHz with their phases shifted by 180° from each other, and about 2 mL of the Contaminon N is added to this water tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolyte solution in the beaker.

(5) The aqueous electrolyte solution in the beaker of (4) is exposed to ultrasound as about 10 mg of toner is added bit by bit to the aqueous electrolyte solution, and dispersed. Ultrasound dispersion is then continued for a further 60 seconds. During ultrasound dispersion, the water temperature in the tank is adjusted appropriately to from 10° C. to 40° C.

(6) The aqueous electrolyte solution of (5) with the toner dispersed therein is dripped with a pipette into the round-bottomed beaker of (1) set on the sample stand, and adjusted to a measurement concentration of about 5%. Measurement is then performed until the number of measured particles reaches 50,000.

(7) The measurement data is analyzed with the dedicated software attached to the apparatus, and the weight-average particle diameter (D4) is calculated. The weight-average particle diameter (D4) is the "Average diameter" on the "Analysis/volume statistical value (arithmetic mean)" screen when Graph/vol % is set in the dedicated software.

EXAMPLES

The present invention is explained using the examples below. However, these do not in any way limit the present invention. Unless otherwise specified, parts in the formulations below are based on mass.

Manufacturing Example of Strontium Titanate Fine Particle

Metatitanic acid obtained by the sulfuric acid method was subjected to deferrous bleaching, sodium hydroxide aqueous solution was added to bring the pH to 9.0, and desulfurization was performed, after which the pH was neutralized to 5.8 with hydrochloric acid, and the product was filtered and washed. Water was added to the washed cake to obtain a slurry containing 1.5 mol/L of $TiO_2$, and hydrochloric acid was added to adjust the pH to 1.5 for peptization.

The desulfurized and peptidized metatitanic acid was collected as $TiO_2$, and placed in a 3 L reaction vessel. A strontium chloride aqueous solution was added to the peptidized metatitanic acid slurry to obtain an $SrO/TiO_2$ molar ratio of 1.15, after which the $TiO_2$ concentration was adjusted to 0.8 mol/L. This was then heated to 90° C. under stirring and mixing, and nitrogen gas microbubbling was performed at 600 mL/min as 444 mL of a 10 mol/L sodium hydroxide aqueous solution were added over the course of 45 minutes, after which nitrogen gas microbubbling was performed at 400 mL/min as the slurry was stirred for 1 hour at 95° C.

The reaction slurry was then stirred and cooled to 15° C. as 10° C. cooling water was passed through the jacket of the reaction vessel, hydrochloric acid was added until the pH was 2.0, and stirring was continued for 1 hour. The resulting precipitate was decantation washed, 5.0 mass % of sodium stearate relative to the solids component was dissolved in water and added in the form of an aqueous solution, and stirring was maintained continuously for 2 hours, after which the pH was adjusted to 6.5 with hydrochloric acid, and stirring was maintained continuously for 1 hour to precipitate stearic acid on the surface of the strontium titanate.

This was then filtered and washed, and the resulting cake was left for 10 hours in atmosphere at 120° C., and crushed in a jet mill until no aggregations remained to obtain a strontium titanate (inorganic fine particle 1). In measurement of the inorganic fine particle 1 by powder X-ray diffraction, the diffraction peak of strontium titanate was observed, and the product had a perovskite crystal structure. The physical properties are shown in Table 1.

Manufacturing Example of Calcium Titanate Fine Particle

A calcium titanate fine particle (inorganic fine particle 2) was obtained as in the manufacturing example of the strontium titanate particle 1 except that the strontium chloride was replaced with calcium chloride, and no nitrogen gas microbubbling was performed. The physical properties are shown in Table 1.

Manufacturing Example 1 of Zinc Oxide Fine Particle 200 parts of zinc oxide were added to an aqueous hydrochloric acid solution consisting of 500 parts of 35 mass % hydrochloric acid and 700 parts of purified water, and the zinc oxide was completely dissolved to prepare a zinc chloride aqueous solution. Meanwhile, 460 parts of ammonium carbonate were dissolved in 3,000 parts of purified water to separately prepare an aqueous solution of ammonium bicarbonate. The zinc chloride aqueous solution was added to the ammonium bicarbonate aqueous solution over the course of 60 minutes to produce a sediment. The sediment was thoroughly washed, separated from the liquid phase, and dried for 5 hours at 130° C.

Next, the dried powder was crushed in an agate mortar. The crushed powder was heated to 500° C. at a rate of 200° C./hour as a mixed gas of 0.21 L/minute of nitrogen gas and 0.09 L/minute of hydrogen gas was supplied. This was maintained as is for 2 hours and then cooled to room temperature, after which sodium stearate in the amount of 5.0 mass % of the resulting zinc oxide fine particle was dissolved in water and added in the form of an aqueous solution, continuous stirring was maintained for 2 hours, hydrochloric acid was added to adjust the pH to 6.5, and continuous stirring was maintained for 1 hour to precipitate stearic acid on the surface of the zinc oxide fine particle.

This was then filtered and washed to obtain a cake that was next dried for 10 hours in atmosphere at 120° C., and crushed in a jet mill until no aggregations remained to obtain a zinc oxide fine particle (inorganic fine particle 3). The physical properties are shown in Table 1.

Titanium Oxide Fine Particle Manufacturing Example 1

A hydrated titanium oxide slurry obtained by thermal hydrolysis of a titanyl sulfate aqueous solution was neutralized to pH 7 with ammonia water, and filtered and washed to obtain a cake, and the titanium oxide of the cake was peptized with hydrochloric acid to obtain an anatase-type titania sol. The average primary particle diameter of this sol was 7 nm.

Using ilmenite ore containing 50 mass % of $TiO_2$ equivalent as a starting material, this starting material was dried for 2 hours at 150° C., and dissolved by addition of sulfuric acid to obtain a $TiOSO_4$ aqueous solution. This was concentrated, 4.0 parts of the above anatase titania sol were added as a seed to 100 parts of $TiO_2$ equivalents, and hydrolysis was performed at 120° C. to obtain a slurry of $TiO(OH)_2$ containing impurities.

This slurry was repeatedly water washed at pH 5 to 6 to thoroughly remove the sulfuric acid, $FeSO_4$ and impurities. A slurry of high-purity metatitanic acid [$TiO(OH)_2$] was then obtained.

This metatitanic acid was heat treated for 6 hours at 270° C., then thoroughly crushed to obtain an anatase crystal titanium oxide fine particle with a BET specific surface area of 50 $m^2/g$ and a number-average particle diameter of 50 nm.

Next, sodium stearate in the amount of 5.0 mass % of the anatase titanium oxide fine particle was added in the form of an aqueous solution dissolved in water, continuous stirring was maintained for 2 hours, hydrochloric acid was added to adjust the pH to 6.5, and continuous stirring was maintained for 1 hour.

This was then filtered and washed, and the resulting cake was dried in atmosphere for 10 hours at 120° C. and crushed in a jet mill until no aggregations remained to obtain a titanium oxide fine particle (inorganic fine particle 4). The physical properties are shown in Table 1.

Titanium Oxide Fine Particle Manufacturing Example 2

After the aqueous solution of dissolved sodium stearate was added in the titanium oxide fine particle manufacturing example 1, aluminum sulfate aqueous solution was added under stirring to precipitate aluminum stearate onto the surface of the titanium oxide fine particle. This was then filtered and washed to obtain a cake that was dried in atmosphere for 10 hours at 120° C. and crushed in a jet mill until no aggregations of titanium oxide fine particles remained to obtain a titanium oxide fine particle 2 (inorganic fine particle 5). The physical properties are shown in Table 1.

Titanium Oxide Fine Particle Manufacturing Example 3

A titanium oxide fine particle 3 (inorganic fine particle 6) was obtained as in the titanium oxide fine particle manufacturing example 1 except that an aqueous solution of dissolved sodium laurate was used instead of the aqueous solution of dissolved sodium stearate. The physical properties are shown in Table 1.

Titanium Oxide Fine Particle Manufacturing Example 4

In the titanium oxide fine particle manufacturing example 1, the following operations were performed after the anatase titanium oxide fine particle was obtained. Hydrochloric acid was added to the dispersion of the anatase titanium oxide fine particle to adjust the pH to 6.5, 0.5 parts of octyl modified silicone oil (FZ-3196; Dow Corning) were added per 100 parts of the anatase titanium oxide fine particle, and continuous stirring was maintained for 1 hour.

This was then filtered and washed to obtain a cake that was dried in atmosphere for 10 hours at 120° C. and crushed in a jet mill until no aggregations of titanium oxide fine particles remained to obtain a titanium oxide fine particle 4 (inorganic fine particle 7). The physical properties are shown in Table 1.

Titanium Oxide Fine Particle Manufacturing Example 5

A titanium oxide fine particle 5 (inorganic fine particle 8) was manufactured as in the titanium oxide fine particle manufacturing example 1 except that an aqueous solution of dissolved sodium behenate was instead of the aqueous solution of dissolved sodium stearate. The physical properties are shown in Table 1.

Titanium Oxide Fine Particle Manufacturing Example 6

In the titanium oxide fine particle manufacturing example 1, the following operations were performed after the anatase titanium oxide fine particle was obtained. The dispersion of the anatase titanium oxide fine particle was adjusted to 50° C., and hydrochloric acid was added to adjust the pH to 2.5, after which 5 parts of stearyl trimethoxysilane were added per 100 parts of the solids component, and continuous stirring was maintained for 6 hours.

Next, sodium hydroxide solution was added to adjust the pH1- to 6.5, continuous stirring was maintained for 1 hour, and filtration and washing were performed to obtain a cake that was then dried for 10 hours in atmosphere at 120° C. This was then crushed in a jet mill until no aggregations of titanium oxide fine particles remained to obtain a titanium oxide fine particle 6 (inorganic fine particle 9). The physical properties are shown in Table 1.

Titanium Oxide Fine Particle Manufacturing Example 7

A titanium oxide fine particle 7 (inorganic fine particle 10) was manufactured as in the titanium oxide fine particle manufacturing example 6 except that octyl trimethoxysilane was used instead of stearyl trimethoxysilane. The physical properties are shown in Table 1.

Titanium Oxide Fine Particle Manufacturing Example 8

A titanium oxide fine particle 8 (inorganic fine particle 11) was manufactured as in the titanium oxide fine particle manufacturing example 6 except that isobutyl trimethoxysilane was used instead of stearyl trimethoxysilane. The physical properties are shown in Table 1.

Titanium Oxide Fine Particle Manufacturing Example 9

In the titanium oxide fine particle manufacturing example 1, the following operations were performed after the anatase titanium oxide fine particle was obtained. The anatase titanium oxide fine particle was placed in an autoclave together with a 20/80 vol % mixed solution of 1-tetracosanol and n-hexane. This was heated for 1 hour at 240° C. under 2.8 MPa of pressure. This was then filtered and washed to obtain a cake that was dried in atmosphere for 10 hours at 120° C. and crushed in a jet mill until no aggregations of titanium oxide fine particles remained to obtain a titanium oxide fine particle 9 (inorganic fine particle 12). The physical properties are shown in Table 1.

Titanium Oxide Fine Particle Manufacturing Example 10

A titanium oxide fine particle 10 (inorganic fine particle 13) was obtained as in the titanium oxide fine particle manufacturing example 9 except that n-butanol was used instead of 1-tetracosanol. The physical properties are shown in Table 1.

Titanium Oxide Fine Particle Manufacturing Example 11

A titanium oxide fine particle 11 (inorganic fine particle 14) was obtained as in the titanium oxide fine particle manufacturing example 9 except that n-octacosanol was used instead of 1-tetracosanol. The physical properties are shown in Table 1.

Titanium Oxide Fine Particle Manufacturing Example 12

A titanium oxide fine particle 12 (inorganic fine particle 15) was obtained as in the titanium oxide fine particle manufacturing example 9 except that n-propanol was used instead of 1-tetracosanol. The physical properties are shown in Table 1.

Zinc Oxide Fine Particle Manufacturing Example 2

In the zinc oxide fine particle manufacturing example 1, manufacturing was performed by the following methods using the zinc oxide fine particle before addition of the sodium stearate aqueous solution.

The zinc oxide fine particle was placed in an autoclave together with a 20/80 vol % mixed solution of n-propanol and n-hexane. This was heated for 1 hour at 240° C. under 2.8 MPa of pressure. This was then filtered and washed to obtain a cake that was dried in atmosphere for 10 hours at 120° C. This was then crushed in a jet mill until no aggregations of zinc oxide fine particles remained to obtain a zinc oxide fine particle 2 (inorganic fine particle 16).

Titanium Oxide Fine Particle Manufacturing Example 13

A titanium oxide fine particle 13 (inorganic fine particle 17) was obtained as in the titanium oxide fine particle manufacturing example 12 except that the mixing ratio of the mixed n-propanol/n-hexane solution was changed to 5/95. The physical properties are shown in Table 1.

Titanium Oxide Fine Particle Manufacturing Example 14

A titanium oxide fine particle 14 (inorganic fine particle 18) was obtained as in the titanium oxide fine particle manufacturing example 1 except that the particle was not treated with sodium stearate aqueous solution. The physical properties are shown in Table 1.

Manufacturing Example of Antimony-doped Tin Oxide Fine Particle

An antimony-doped tin oxide fine particle (inorganic fine particle 19) was obtained as in the titanium oxide fine particle manufacturing example 12 except that an antimony-doped tin oxide fine particle (SN-100P, Ishihara Sangyo) was used instead of the anatase titanium oxide fine particle. The physical properties are shown in Table 1.

Silica Fine Particle Manufacturing Example

A silica fine particle (inorganic fine particle 20) was manufactured as in the titanium oxide fine particle manufacturing example 12 except that a silica fine particle manufactured by the following method was used instead of the anatase titanium oxide fine particle. The physical properties are shown in Table 1.

A double-pipe hydrocarbon-oxygen mixed burner capable of forming an inner flame and an outer flame was used as a combustion furnace. A two-fluid nozzle for slurry injection was installed at the center of the burner, and a raw material silicon compound was introduced. A hydrocarbon-oxygen combustion gas was sprayed from around the two-fluid nozzle, to form an outer flame and an inner flame as a reducing atmosphere.

The atmosphere, temperature, length of the flame and the like were adjusted by controlling the amount and flow rate of the combustion gas and oxygen. A silica fine particle was formed in the flame from the silicon compound, and fused until the desired particle diameter was obtained. This was then cooled, and collected in a bag filter to obtain a silica fine particle.

TABLE 1

| Inorganic particle No. | Composition | Surface treatment | Carbon number in the alkyl group | Number average diameter of primary particle nm | Volume resistivity Ω · cm | Dielectric constant pF/m |
|---|---|---|---|---|---|---|
| 1 | Strontium titanate | Stearic acid | C18 | 40 | 1.0E+10 | 35 |
| 2 | Calcium titanate | Stearic acid | C18 | 60 | 8.0E+08 | 90 |
| 3 | Zinc oxide | Stearic acid | C18 | 25 | 2.0E+08 | 21 |
| 4 | Titanium oxide | Stearic acid | C18 | 35 | 1.0E+11 | 26 |
| 5 | Titanium oxide | Aluminum stearate | C18 | 35 | 1.0E+10 | 28 |
| 6 | Titanium oxide | Lauric acid | C12 | 35 | 8.0E+10 | 28 |
| 7 | Titanium oxide | Octyl-modified silicone oil | C8 | 35 | 3.0E+12 | 26 |
| 8 | Titanium oxide | Behenic acid | C22 | 35 | 7.0E+11 | 24 |
| 9 | Titanium oxide | Stearyl trimethoxysilane | C18 | 35 | 6.0E+12 | 24 |
| 10 | Titanium oxide | Octyl trimethoxysilane | C8 | 35 | 4.0E+12 | 24 |
| 11 | Titanium oxide | Isobutyl trimethoxysilane | C4 | 35 | 3.0E+12 | 24 |
| 12 | Titanium oxide | 1-Tetracosanol | C24 | 35 | 9.0E+11 | 25 |
| 13 | Titanium oxide | n-Butanol | C4 | 35 | 9.0E+11 | 25 |

TABLE 1-continued

| Inorganic particle No. | Composition | Surface treatment | Carbon number in the alkyl group | Number average diameter of primary particle nm | Volume resistivity Ω · cm | Dielectric constant pF/m |
|---|---|---|---|---|---|---|
| 14 | Titanium oxide | 1-Octocosanol | C28 | 35 | 9.0E+11 | 26 |
| 15 | Titanium oxide | n-Propanol | C3 | 35 | 1.0E+12 | 24 |
| 16 | Zinc oxide | n-Propanol | C3 | 35 | 2.0E+05 | 20 |
| 17 | Titanium oxide | n-Propanol | C3 | 35 | 8.0E+12 | 45 |
| 18 | Titanium oxide | None | None | 35 | 1.0E+12 | 60 |
| 19 | ATO | n-Propanol | C3 | 25 | 1.0E+01 | — |
| 20 | Silica | n-Propanol | C3 | 45 | 1.0E+14 | 15 |

In the descriptions of volume resistivity in the table, "1.0E+10" means "$1.0\times10^{10}$" for example.

The abbreviation in Table 1 is as follows.

ATO: Antimony-doped tin oxide

Manufacturing Example of Polymer 1

| | |
|---|---|
| Solvent: Toluene | 100.0 parts |
| Monomer composition (The monomer composition is a mixture of the following behenyl acrylate, methacrylonitrile and styrene in the following proportions.) | 100.0 parts |
| Behenyl acrylate (first polymerizable monomer) | 67.0 parts (28.9 mol %) |
| Methacrylonitrile (second polymerizable monomer) | 22.0 parts (53.8 mol %) |
| Styrene (third polymerizable monomer) | 11.0 parts (17.3 mol %) |
| Polymerization initiator: t-butyl peroxypivalate (Perbutyl PV, NOF Corp.) | 0.5 parts |

These materials were loaded in a nitrogen atmosphere into a reactor equipped with a reflux condenser, a stirrer, a thermometer and a nitrogen introduction pipe. The reactor contents were stirred at 200 rpm while being heated to 70° C., and a polymerization reaction was performed for 12 hours to obtain a solution of a polymer derived from the monomer composition dissolved in toluene. Next, this solution was cooled to 25° C., and added with stirring to 1,000.0 parts of methanol to precipitate a methanol-insoluble component. The resulting methanol-insoluble component was filtered out, further washed with methanol, and vacuum dried for 24 hours at 40° C. to obtain a polymer 1. The polymer 1 had a weight-average molecular weight of 68,400, a melting point of 62° C. and an acid value of 0.0 mg KOH/g.

NMR analysis of this polymer 1 showed that it contained 28.9 mol % monomer units derived from behenyl acrylate, 53.8 mol % monomer units derived from methacrylonitrile and 17.3 mol % monomer units derived from styrene. The SP values of the monomers and monomer units derived from the monomers were calculated.

Preparation of Monomer Having Urethane Group 50.0 parts of methanol were loaded into a reactor, after which 5.0 parts of KarenzMOI (2-isocyanatoethyl methacrylate, Showa Denko) were added dropwise at 40° C. under stirring. After completion of dropping, this was stirred for 2 hours with the temperature maintained at 40° C. The unreacted methanol was then removed in an evaporator to prepare a monomer having a urethane group.

Preparation of Monomer Having Urea Group 50.0 parts of dibutylamine were loaded into a reactor, after which 5.0 parts of KarenzMOI (2-isocyanatoethyl methacrylate, Showa Denko) were added dropwise at room temperature under stirring. After completion of dropping, this was stirred for 2 hours. The unreacted dibutylamine was then removed in an evaporator to prepare a monomer having a urea group.

Manufacturing Examples of Polymers 2 to 27

Polymers 2 to 27 were obtained as in the manufacturing example of the Polymer 1 except that the respective monomers and mass parts were changed as shown in Table 2. The physical properties are shown in Tables 3 to 5.

TABLE 2

| Polymer | First polymerizable monomer | | | Second polymerizable monomer | | | Third polymerizable monomer | | |
|---|---|---|---|---|---|---|---|---|---|
| A No. | Type | Parts | mol % | Type | Parts | mol % | Type | Parts | mol % |
| 1 | BEA | 67.0 | 28.9 | MN | 22.0 | 53.8 | St | 11.0 | 17.3 |
| 2 | BEA | 67.0 | 25.3 | AN | 22.0 | 59.5 | St | 11.0 | 15.2 |
| 3 | BEA | 50.0 | 26.0 | HPMA | 40.0 | 55.0 | St | 10.0 | 19.0 |
| 4 | BEA | 65.0 | 27.6 | AM | 25.0 | 56.9 | St | 10.0 | 15.5 |
| 5 | BEA | 40.0 | 11.4 | AN | 27.5 | 56.0 | St | 30.0 | 31.2 |
| | | | | UT | 2.5 | 1.4 | | | |
| 6 | BEA | 40.0 | 11.4 | AN | 27.5 | 56.3 | St | 30.0 | 31.3 |
| | | | | UR | 2.5 | 1.0 | | | |
| 7 | BEA | 61.0 | 27.4 | AA | 9.0 | 21.4 | MM | 30.0 | 51.2 |
| 8 | BEA | 60.0 | 26.2 | VA | 30.0 | 57.9 | St | 10.0 | 15.9 |
| 9 | BEA | 60.0 | 26.2 | MA | 30.0 | 57.9 | St | 10.0 | 15.9 |
| 10 | BEA | 89.0 | 58.8 | MN | 11.0 | 41.2 | — | — | — |
| 11 | BEA | 40.0 | 10.5 | MN | 60.0 | 89.5 | — | — | — |
| 12 | BEA | 40.0 | 11.8 | MN | 40.0 | 66.7 | St | 20.0 | 21.5 |
| 13 | BEA | 61.0 | 27.5 | MN | 9.0 | 23.0 | St | 30.0 | 49.5 |
| 14 | BEA | 34.0 | 11.4 | MN | 11.0 | 21.0 | St | 55.0 | 67.6 |
| 15 | SA | 67.0 | 32.3 | MN | 22.0 | 51.2 | St | 11.0 | 16.5 |
| 16 | MYA | 67.0 | 23.9 | MN | 22.0 | 57.6 | St | 11.0 | 18.5 |
| 17 | OA | 67.0 | 25.0 | MN | 22.0 | 56.8 | St | 11.0 | 18.2 |
| 18 | BEA | 63.0 | 28.2 | MN | 7.0 | 17.7 | St | 23.0 | 37.6 |
| | | | | AA | 7.0 | 16.5 | | | |
| 19 | BEA | 63.0 | 26.3 | MN | 15.0 | 35.5 | St | 15.0 | 22.8 |
| | | | | AA | 7.0 | 15.4 | | | |
| 20 | BEA | 47.0 | 20.0 | MN | 22.0 | 53.0 | St | 11.0 | 17.0 |
| | SA | 20.0 | 10.0 | | | | | | |
| 21 | BEA | 33.0 | 14.3 | MN | 22.0 | 54.1 | St | 11.0 | 17.4 |
| | BMA | 34.0 | 14.2 | | | | | | |
| 22 | BEA | 66.6 | 33.2 | AA | 4.8 | 12.6 | MM | 28.6 | 54.2 |
| 23 | BEA | 90.0 | 61.3 | MN | 10.0 | 38.7 | — | — | — |
| 24 | BEA | 61.0 | 28.0 | MN | 7.0 | 18.2 | St | 32.0 | 53.8 |
| 25 | HA | 61.0 | 28.6 | MN | 26.0 | 54.0 | St | 13.0 | 17.4 |

TABLE 2-continued

| Polymer A | First polymerizable monomer | | | Second polymerizable monomer | | | Third polymerizable monomer | | |
|---|---|---|---|---|---|---|---|---|---|
| No. | Type | Parts | mol % | Type | Parts | mol % | Type | Parts | mol % |
| 26 | BEA | 60.0 | 28.5 | — | — | — | St | 11.0 | 19.1 |
| | | | | | | | MM | 29.0 | 52.4 |
| 27 | BEA | 25.0 | 7.0 | VA | 75.0 | 93.0 | — | — | — |

The abbreviations in Tables 2 to 5 are as follows.

BEA: Behenyl acrylate
BMA: Behenyl methacrylate
SA: Stearyl acrylate
MYA: Myricyl acrylate
OA: Octacosyl acrylate
HA: Hexadecyl acrylate
MN: Methacrylonitrile
AN: Acrylonitrile
HPMA: 2-hydroxypropyl methacrylate
AM: Acrylamide
UT: Monomer having urethane group
UR: Monomer having urea group
AA: Acrylic acid
VA: Vinyl acetate
MA: Methyl acrylate
St: Styrene
MM: Methyl methacrylate

TABLE 3

| Polymer A | First polymerizable monomer | | Second polymerizable monomer | | Third polymerizable monomer | | Formula (3) |
|---|---|---|---|---|---|---|---|
| No. | Monomer | $SP_{12}$ | Monomer | $SP_{22}$ | Monomer | $SP_{32}$ | $SP_{22} - SP_{12}$ |
| 1 | BEA | 17.69 | MN | 21.97 | St | 17.94 | 4.28 |
| 2 | BEA | 17.69 | AN | 22.75 | St | 17.94 | 5.06 |
| 3 | BEA | 17.69 | HPMA | 22.05 | St | 17.94 | 4.36 |
| 4 | BEA | 17.69 | AM | 29.13 | St | 17.94 | 11.44 |
| 5 | BEA | 17.69 | AN | 22.75 | St | 17.94 | 5.06 |
| | | | UT | 21.91 | | | 4.22 |
| 6 | BEA | 17.69 | AN | 22.75 | St | 17.94 | 5.06 |
| | | | UR | 20.86 | | | 3.17 |
| 7 | BEA | 17.69 | AA | 22.66 | MM | 18.27 | 4.97 |
| 8 | BEA | 17.69 | VA | 18.31 | St | 17.94 | 0.62 |
| 9 | BEA | 17.69 | MA | 18.31 | St | 17.94 | 0.62 |
| 10 | BEA | 17.69 | MN | 21.97 | — | — | 4.28 |
| 11 | BEA | 17.69 | MN | 21.97 | — | — | 4.28 |
| 12 | BEA | 17.69 | MN | 21.97 | St | 17.94 | 4.28 |
| 13 | BEA | 17.69 | MN | 21.97 | St | 17.94 | 4.28 |
| 14 | BEA | 17.69 | MN | 21.97 | St | 17.94 | 4.28 |
| 15 | SA | 17.71 | MN | 21.97 | St | 17.94 | 4.26 |
| 16 | MYA | 17.65 | MN | 21.97 | St | 17.94 | 4.32 |
| 17 | OA | 17.65 | MN | 21.97 | St | 17.94 | 4.32 |
| 18 | BEA | 17.69 | MN | 21.97 | St | 17.94 | 4.28 |
| | | | AA | 21.66 | | | 3.97 |
| 19 | BEA | 17.69 | MN | 21.97 | St | 17.94 | 4.28 |
| | | | AA | 21.66 | | | 3.97 |
| 20 | BEA | 17.69 | MN | 21.97 | St | 17.94 | 4.27 |
| | SA | 17.71 | | | | | |
| 21 | BEA | 17.69 | MN | 21.97 | St | 17.94 | 4.32 |
| | BMA | 17.61 | | | | | |
| 22 | BEA | 17.69 | AA | 22.66 | MM | 18.27 | 4.97 |
| 23 | BEA | 17.69 | MN | 21.97 | — | — | 4.28 |
| 24 | BEA | 17.69 | MN | 21.97 | St | 17.94 | 4.28 |
| 25 | HA | 17.73 | MN | 21.97 | St | 17.94 | 4.24 |
| 26 | BEA | 17.69 | — | — | St | 17.94 | — |
| | | | | | MM | 18.27 | — |
| 27 | BEA | 17.69 | VA | 18.31 | — | — | 0.62 |

TABLE 4

| Polymer A | Monomer unit derived from first polymerizable monomer | | Monomer unit derived from second polymerizable monomer | | Monomer unit derived from third polymerizable monomer | | Formula (1) |
|---|---|---|---|---|---|---|---|
| No. | Unit | $SP_{11}$ | Unit | $SP_{21}$ | Unit | $SP_{31}$ | $SP_{21} - SP_{11}$ |
| 1 | BEA | 18.25 | MN | 25.96 | St | 20.11 | 7.71 |
| 2 | BEA | 18.25 | AN | 29.43 | St | 20.11 | 11.18 |
| 3 | BEA | 18.25 | HPMA | 24.12 | St | 20.11 | 5.87 |
| 4 | BEA | 18.25 | AM | 39.25 | St | 20.11 | 21.00 |
| 5 | BEA | 18.25 | AN | 29.43 | St | 20.11 | 11.18 |
| | | | UT | 23.79 | | | 5.54 |
| 6 | BEA | 18.25 | AN | 29.43 | St | 20.11 | 11.18 |
| | | | UR | 21.74 | | | 3.49 |
| 7 | BEA | 18.25 | AA | 28.72 | MM | 20.31 | 10.47 |
| 8 | BEA | 18.25 | VA | 21.60 | St | 20.11 | 3.35 |
| 9 | BEA | 18.25 | MA | 21.60 | St | 20.11 | 3.35 |
| 10 | BEA | 18.25 | MN | 25.96 | — | — | 7.71 |
| 11 | BEA | 18.25 | MN | 25.96 | — | — | 7.71 |
| 12 | BEA | 18.25 | MN | 25.96 | St | 20.11 | 7.71 |
| 13 | BEA | 18.25 | MN | 25.96 | St | 20.11 | 7.71 |
| 14 | BEA | 18.25 | MN | 25.96 | St | 20.11 | 7.71 |
| 15 | SA | 18.39 | MN | 25.96 | St | 20.11 | 7.57 |
| 16 | MYA | 18.08 | MN | 25.96 | St | 20.11 | 7.88 |
| 17 | OA | 18.10 | MN | 25.96 | St | 20.11 | 7.86 |
| 18 | BEA | 18.25 | MN | 25.96 | St | 20.11 | 7.71 |
| | | | AA | 28.72 | | | 10.47 |
| 19 | BEA | 18.25 | MN | 25.96 | St | 20.11 | 7.71 |
| | | | AA | 28.72 | | | 10.47 |
| 20 | BEA | 18.25 | MN | 25.96 | St | 20.11 | 7.66 |
| | SA | 18.39 | | | | | |
| 21 | BEA | 18.25 | MN | 25.96 | St | 20.11 | 7.79 |
| | BMA | 18.10 | | | | | |
| 22 | BEA | 18.25 | AA | 28.72 | MM | 20.31 | 10.47 |
| 23 | BEA | 18.25 | MN | 25.96 | — | — | 7.71 |
| 24 | BEA | 18.25 | MN | 25.96 | St | 20.11 | 7.71 |
| 25 | HA | 18.47 | MN | 25.96 | St | 20.11 | 7.49 |
| 26 | BEA | 18.25 | — | — | St | 20.11 | — |
| | | | | | MM | 20.31 | — |
| 27 | BEA | 18.25 | VA | 21.60 | — | — | 3.35 |

TABLE 5

| Polymer A No. | Mw | $T_p$ [° C.] | Av [mgKOH/g] |
|---|---|---|---|
| 1 | 68400 | 62 | 0.0 |
| 2 | 67100 | 62 | 0.0 |
| 3 | 67500 | 59 | 0.0 |
| 4 | 63900 | 59 | 0.0 |
| 5 | 63900 | 55 | 0.0 |
| 6 | 68100 | 55 | 0.0 |
| 7 | 62800 | 57 | 70.0 |
| 8 | 64600 | 56 | 0.0 |
| 9 | 66400 | 54 | 0.0 |
| 10 | 65800 | 62 | 0.0 |
| 11 | 66500 | 56 | 0.0 |
| 12 | 62800 | 55 | 0.0 |
| 13 | 64600 | 57 | 0.0 |
| 14 | 64500 | 53 | 0.0 |
| 15 | 66400 | 54 | 0.0 |
| 16 | 62900 | 76 | 0.0 |
| 17 | 64500 | 78 | 0.0 |
| 18 | 67800 | 58 | 54.4 |
| 19 | 64700 | 61 | 54.5 |
| 20 | 66100 | 58 | 0.0 |
| 21 | 68900 | 62 | 0.0 |
| 22 | 63500 | 56 | 37.3 |
| 23 | 67100 | 62 | 0.0 |
| 24 | 61900 | 56 | 0.0 |
| 25 | 66600 | 45 | 0.0 |
| 26 | 63800 | 52 | 0.0 |
| 27 | 64600 | 59 | 0.0 |

Synthesis Example 1 of Amorphous Resin Other Than Polymer A 50 parts of xylene were placed in an autoclave, nitrogen was substituted, and the temperature was raised to 185° C. in a sealed state under stirring. A mixed solution of 95 parts of styrene, 5 parts of n-butyl acrylate, 5 parts of di-t-butyl peroxide and 20 parts of xylene was dropped in continuously for 3 hours and polymerized with the internal temperature of the autoclave controlled at 185° C. This was then maintained at the same temperature for 1 hour to complete polymerization, and the solvent was removed to obtain an amorphous resin 1 that was not the polymer A. The resulting resin had a weight-average molecular weight (Mw) of 3,500, a softening point (Tm) of 96° C. and a glass transition temperature (Tg) of 58° C.

Manufacturing Example of Polymer Fine Particle 1 Dispersion

| | |
|---|---|
| Toluene (Wako Pure Chemical) | 300 parts |
| Polymer 1 | 100 parts |

These materials were weighed precisely, mixed, and dissolved at 90° C.

Separately, 5.0 parts of sodium dodecylbenzene sulfonate and 10.0 parts of sodium laurate were added to 700 parts of ion-exchanged water, and heated to dissolve at 90° C. The previous toluene solution was then mixed with this aqueous solution, and stirred at 7,000 rpm with a T. K. Robomix ultra high-speed mixer (Primix). This was emulsified under 200 MPa of pressure with a Nanomizer high-pressure impact disperser (Yoshida Kikai). The toluene was then removed with an evaporator, and the concentration was adjusted with ion-exchanged water to obtain a water-based dispersion with a concentration of 20 mass % of the polymer fine particle 1 (polymer fine particle 1 dispersion).

The 50% volume-based particle diameter (D50) of the polymer fine particle 1 was 0.40 μm as measured with a Nanotrac UPA-EX150 dynamic light scattering particle size distribution meter (Nikkiso).

Manufacturing Examples of Polymer Fine Particle 2 to 27 Dispersions

Dispersions of the polymer fine particles 2 to 27 were obtained by emulsification as in the manufacturing example of the polymer fine particle 1 dispersion except that the polymers were changed as shown in Table 6. The physical properties are shown in Table 6.

TABLE 6

| Polymer fine particle dispersion | Toluene solution | | | Aqueous solution | | Physical properties |
|---|---|---|---|---|---|---|
| | Toluene | Polymer A | | Sodium dodecylbenzene sulfonate | Sodium laurate | D50 |
| No. | Parts | No. | Parts | Parts | Parts | [μm] |
| 1 | 300 | 1 | 100 | 5 | 10 | 0.4 |
| 2 | 300 | 2 | 100 | 5 | 10 | 0.4 |
| 3 | 300 | 3 | 100 | 5 | 10 | 0.4 |
| 4 | 300 | 4 | 100 | 5 | 10 | 0.4 |
| 5 | 300 | 5 | 100 | 5 | 10 | 0.4 |

TABLE 6-continued

| Polymer fine particle dispersion | Toluene solution | | | Aqueous solution | | Physical properties |
|---|---|---|---|---|---|---|
| | Toluene | Polymer A | | Sodium dodecylbenzene sulfonate | Sodium laurate | D50 |
| No. | Parts | No. | Parts | Parts | Parts | [μm] |
| 6 | 300 | 6 | 100 | 5 | 10 | 0.4 |
| 7 | 300 | 7 | 100 | 5 | 10 | 0.4 |
| 8 | 300 | 8 | 100 | 5 | 10 | 0.4 |
| 9 | 300 | 9 | 100 | 5 | 10 | 0.4 |
| 10 | 300 | 10 | 100 | 5 | 10 | 0.4 |
| 11 | 300 | 11 | 100 | 5 | 10 | 0.4 |
| 12 | 300 | 12 | 100 | 5 | 10 | 0.4 |
| 13 | 300 | 13 | 100 | 5 | 10 | 0.4 |
| 14 | 300 | 14 | 100 | 5 | 10 | 0.4 |
| 15 | 300 | 15 | 100 | 5 | 10 | 0.4 |
| 16 | 300 | 16 | 100 | 5 | 10 | 0.4 |
| 17 | 300 | 17 | 100 | 5 | 10 | 0.4 |
| 18 | 300 | 18 | 100 | 5 | 10 | 0.4 |
| 19 | 300 | 19 | 100 | 5 | 10 | 0.4 |
| 20 | 300 | 20 | 100 | 5 | 10 | 0.4 |
| 21 | 300 | 21 | 100 | 5 | 10 | 0.4 |
| 22 | 300 | 22 | 100 | 5 | 10 | 0.4 |
| 23 | 300 | 23 | 100 | 5 | 10 | 0.4 |
| 24 | 300 | 24 | 100 | 5 | 10 | 0.4 |
| 25 | 300 | 25 | 100 | 5 | 10 | 0.4 |
| 26 | 300 | 26 | 100 | 5 | 10 | 0.4 |
| 27 | 300 | 27 | 100 | 5 | 10 | 0.4 |

Manufacturing Example of Dispersion of Amorphous Resin Fine Particle 1 Other Than Polymer A

| | |
|---|---|
| Tetrahydrofuran (Wako Pure Chemical) | 300 parts |
| Amorphous resin 1 other than polymer A | 100 parts |
| Anionic surfactant Neogen RK (Daiichi Kogyo) | 0.5 parts |

These materials were weighed precisely, mixed and dissolved.

20.0 parts of 1 mol/L ammonia water was then added, and stirred at 4000 rpm with a T. K. Robomix ultra high-speed mixer (Primix). 700 parts of ion-exchanged water were then added at a rate of 8 g/min, to precipitate an amorphous resin fine particle that was not the polymer A. The tetrahydrofuran was then removed with an evaporator, and the concentration was adjusted with ion-exchanged water to obtain a water-based dispersion having a concentration of 20 mass % of an amorphous resin fine particle 1 that was not the polymer A (amorphous resin fine particle 1 dispersion).

The volume-based 50% particle diameter (D50) of the amorphous resin fine particle 1 that was not the polymer A was 0.13 μm.

Manufacturing Example of Release Agent (Aliphatic Hydrocarbon Compound) Fine Particle Dispersion

| | |
|---|---|
| Aliphatic hydrocarbon compound HNP-51 (Nippon Seiro) | 100 parts |
| Anionic surfactant Neogen RK (Daiichi Kogyo) | 5 parts |
| Ion-exchanged water | 395 parts |

These materials were weighed precisely, placed in a mixing vessel with an attached stirrer, heated to 90° C., and then dispersed for 60 minutes by recirculating into a Clearmix W-Motion (M Technique). The dispersion conditions were as follows.

| | |
|---|---|
| Outer rotor diameter | 3 cm |
| Clearance | 0.3 mm |
| Rotor speed | 19,000 r/min |
| Screen rotation | 19,000 r/min |

After being dispersed, this was cooled to 40° C. under conditions of rotor speed 1,000 r/min, screen rotation 0 r/min, cooling speed 10° C./min to obtain a water-based dispersion (release agent (aliphatic hydrocarbon compound) fine particle dispersion) having a concentration of 20 mass % of the release agent (aliphatic hydrocarbon compound) fine particle.

The 50% volume-based particle diameter (D50) of the release agent (aliphatic hydrocarbon compound) fine particle was 0.15 μm as measured with a Nanotrac UPA-EX150 dynamic light scattering particle size distribution meter (Nikkiso).

Manufacture of Colorant Fine Particle Dispersion

| | |
|---|---|
| Colorant (Cyan pigment, Dainichi Seika Pigment Blue 15:3) | 50.0 parts |
| Neogen RK anionic surfactant (Daiichi Kogyo Seiyaku) | 7.5 parts |
| Ion-exchanged water | 442.5 parts |

These materials were weighed precisely, mixed, dissolved, and dispersed for about 1 hour with a with a Nanomizer high-pressure impact disperser (Yoshida Kikai) to disperse the colorant and obtained a water-based dispersion (colorant fine particle dispersion) having a concentration of 10 mass % of the colorant fine particle.

The 50% volume-based particle diameter (D50) of the colorant fine particle 1 was 0.20 μm as measured with a Nanotrac UPA-EX150 dynamic light scattering particle size distribution meter (Nikkiso).

Manufacturing Example of Toner Particle 1

| | |
|---|---|
| Polymer fine particle 1 dispersion | 500 parts |
| Release agent (aliphatic hydrocarbon compound fine particle dispersion) | 50 parts |
| Colorant fine particle dispersion | 80 parts |
| Ion-exchanged water | 160 parts |

These materials were loaded into a round-bottomed stainless steel flask, and mixed. This was then dispersed for 10 minutes at 5,000 r/min with an Ultra Turrax T50 homogenizer (IKA). 1.0% aqueous nitric acid solution was added to adjust the pH to 3.0, after which the mixture was heated to 58° C. in a heating water bath using a stirring blade while adjusting number of rotations so that the mixture could be stirred. The volume-average particle diameter of the formed aggregated particles was checked appropriately with a Coulter Multisizer III, and once aggregated particles with a weight-average particle diameter (D4) of about 6.00 μm had formed, the pH was adjusted to 9.0 with a 5% sodium hydroxide aqueous solution. Stirring was then continued as the mixture was heated to 75° C. This was then maintained at 75° C. for 1 hour to fuse the aggregated particles.

This was then cooled to 50° C., and maintained for 3 hours to promote crystallization of the polymer.

This was then cooled to 25° C., subjected to filtration and solid-liquid separation, and washed with ion-exchanged water. After completion of washing it was dried with a vacuum drier to obtain a toner particle 1 with a weight-average particle diameter (D4) of about 6.1 μm.

TABLE 7

| Toner No. | Toner particle No. | Manufacturing method | Polymer No. | Parts | Other resin | Parts | Inorganic fine particle No. | Parts |
|---|---|---|---|---|---|---|---|---|
| 1 | 1 | EA | 1 | 100 | None | — | 1 | 0.5 |
| 2 | 2 | SP | 1 | 100 | None | — | 1 | 0.5 |
| 3 | 3 | DS | 1 | 100 | None | — | 1 | 0.5 |
| 4 | 4 | MK | 1 | 100 | None | — | 1 | 0.5 |
| 5 | 1 | EA | 1 | 100 | None | — | 2 | 0.5 |
| 6 | 1 | EA | 1 | 100 | None | — | 3 | 0.5 |
| 7 | 1 | EA | 1 | 100 | None | — | 4 | 0.5 |
| 8 | 1 | EA | 1 | 100 | None | — | 5 | 0.5 |
| 9 | 1 | EA | 1 | 100 | None | — | 6 | 0.5 |
| 10 | 1 | EA | 1 | 100 | None | — | 7 | 0.5 |
| 11 | 1 | EA | 1 | 100 | None | — | 8 | 0.5 |
| 12 | 1 | EA | 1 | 100 | None | — | 9 | 0.5 |
| 13 | 1 | EA | 1 | 100 | None | — | 10 | 0.5 |
| 14 | 1 | EA | 1 | 100 | None | — | 11 | 0.5 |
| 15 | 1 | EA | 1 | 100 | None | — | 12 | 0.5 |
| 16 | 1 | EA | 1 | 100 | None | — | 13 | 0.5 |
| 17 | 1 | EA | 1 | 100 | None | — | 14 | 0.5 |
| 18 | 1 | EA | 1 | 100 | None | — | 15 | 0.5 |
| 19 | 1 | EA | 1 | 100 | None | — | 15 | 0.3 |
| 20 | 1 | EA | 1 | 100 | None | — | 15 | 1.0 |
| 21 | 1 | EA | 1 | 100 | None | — | 15 | 2.0 |
| 22 | 1 | EA | 1 | 100 | None | — | 15 | 0.2 |
| 23 | 5 | EA | 2 | 100 | None | — | 15 | 0.2 |
| 24 | 6 | EA | 3 | 100 | None | — | 15 | 0.2 |
| 25 | 7 | EA | 4 | 100 | None | — | 15 | 0.2 |
| 26 | 8 | EA | 5 | 100 | None | — | 15 | 0.2 |
| 27 | 9 | EA | 6 | 100 | None | — | 15 | 0.2 |
| 28 | 10 | EA | 7 | 100 | None | — | 15 | 0.2 |
| 29 | 11 | EA | 8 | 100 | None | — | 15 | 0.2 |
| 30 | 12 | EA | 9 | 100 | None | — | 15 | 0.2 |

TABLE 7-continued

| Toner No. | Toner particle No. | Manufacturing method | Polymer No. | Parts | Other resin | Parts | Inorganic fine particle No. | Parts |
|---|---|---|---|---|---|---|---|---|
| 31 | 13 | EA | 10 | 100 | None | — | 15 | 0.2 |
| 32 | 14 | EA | 11 | 100 | None | — | 15 | 0.2 |
| 33 | 15 | EA | 12 | 100 | None | — | 15 | 0.2 |
| 34 | 16 | EA | 13 | 100 | None | — | 15 | 0.2 |
| 35 | 17 | EA | 14 | 100 | None | — | 15 | 0.2 |
| 36 | 18 | EA | 15 | 100 | None | — | 15 | 0.2 |
| 37 | 19 | EA | 16 | 100 | None | — | 15 | 0.2 |
| 38 | 20 | EA | 17 | 100 | None | — | 15 | 0.2 |
| 39 | 21 | EA | 18 | 100 | None | — | 15 | 0.2 |
| 40 | 22 | EA | 19 | 100 | None | — | 15 | 0.2 |
| 41 | 23 | EA | 20 | 100 | None | — | 15 | 0.2 |
| 42 | 24 | EA | 1 | 51 | Amorphous resin 1 | 49 | 15 | 0.2 |
| 43 | 25 | EA | 1 | 40 | Amorphous resin 1 | 60 | 15 | 0.2 |
| 44 | 26 | EA | 21 | 100 | None | — | 15 | 0.2 |
| 45 | 1 | EA | 1 | 100 | None | — | 16 | 0.2 |
| 46 | 1 | EA | 1 | 100 | None | — | 17 | 0.2 |
| 47 | 27 | EA | 22 | 100 | None | — | 15 | 0.2 |
| 48 | 28 | EA | 23 | 100 | None | — | 15 | 0.2 |
| 49 | 29 | EA | 24 | 100 | None | — | 15 | 0.2 |
| 50 | 30 | EA | 25 | 100 | None | — | 15 | 0.2 |
| 51 | 31 | EA | 26 | 100 | None | — | 15 | 0.2 |
| 52 | 1 | EA | 1 | 100 | None | — | 18 | 0.2 |
| 53 | 1 | EA | 1 | 100 | None | — | 19 | 0.2 |
| 54 | 1 | EA | 1 | 100 | None | — | 20 | 0.2 |
| 55 | 32 | EA | 27 | 100 | None | — | 15 | 0.2 |

In the table, EA denotes emulsion aggregation, SP denotes suspension polymerization, DS denotes dissolution suspension and MK denotes melt kneading.

Toner Particle Manufacturing Example 2

| | |
|---|---|
| Monomer composition<br>(The monomer composition is a mixture of the following behenyl acrylate, methacrylonitrile and styrene in the following proportions)<br>(Behenyl acrylate (first polymerizable monomer) 67.0 parts (28.9 mol %))<br>(Methacrylonitrile (second polymerizable monomer) 22.0 parts (53.8 mol %))<br>(Styrene (third polymerizable monomer) 11.0 parts (17.3 mol %)) | 100.0 parts |
| Colorant Pigment blue 15:3 | 6.5 parts |
| Aluminum di-t-butylsalicylate aluminum | 1.0 parts |
| Paraffin wax<br>(Nippon Seiro: HNP-51) | 10.0 parts |
| Toluene | 100.0 parts |

A mixture consisting of the above materials was prepared, loaded into an attritor (Nippon Coke & Engineering), and dispersed for 2 hours at 200 rpm with zirconia beads 5 mm in diameter to obtain a raw material dispersion.

Meanwhile, 735.0 parts of ion-exchanged water and 16.0 parts of trisodium phosphate (12-hydrate) were added to a vessel provided with a Homomixer high-speed agitator (Primix) and a thermometer, and stirred at 12,000 rpm as the temperature was raised to 60° C. A calcium chloride aqueous solution of 9.0 parts of calcium chloride (2-hydrate) dissolved in 65.0 parts of ion-exchanged water was added, and stirred for 30 minutes at 12,000 rpm with the temperature maintained at 60° C. 10% hydrochloric acid was added to adjust the pH to 6.0 and obtain a water-based medium containing a dispersion stabilizer.

Next, the above raw material dispersion was transferred to a vessel equipped with a stirrer and a thermometer, and stirred at 100 rpm as the temperature was raised to 60° C. 8.0 parts of t-butyl peroxypivalate (NOF: Perbutyl PV) were then added as a polymerization initiator, and the mixture was stirred for 5 minutes at 100 rpm with the temperature maintained at 60° C., and then added to the water-based medium as the medium was stirred at 12,000 rpm with the high-speed stirring device.

The temperature was then maintained at 60° C. as stirring was continued for 20 minutes at 12,000 rpm with the high-speed stirring device to obtain a granulating liquid. This granulating liquid was transferred to a reactor equipped with a reflux condenser, a stirrer, a thermometer and a nitrogen introduction pipe, and stirred at 150 rpm in a nitrogen atmosphere as the temperature was raised to 70° C. A polymerization reaction was then performed for 10 hours at 150 rpm with the temperature maintained at 70° C. The reflux condenser was then removed from the reactor, the temperature of the reaction solution was raised to 95° C., and the solution was stirred for 5 hours at 150 rpm with the temperature maintained at 95° C. to remove the toluene and obtain a toner particle dispersion.

The resulting toner particle dispersion was cooled to 20° C. while being stirred at 150 rpm, after which stirring was maintained as dilute hydrochloric acid was added to adjust the pH to 1.5 and dissolve the dispersion stabilizer. The solids were filtered out, and after thorough washing with ion-exchanged water, this was vacuum dried for 24 hours at 40° C. to obtain a toner particle 2.

Toner Particle Manufacturing Example 3

Preparation of Fine Particle Dispersion 1

683.0 parts of water, 11.0 parts of a sodium salt of methacrylic acid EO adduct sulfate ester (Eleminol RS-30, Sanyo Chemical), 130.0 parts of styrene, 138.0 parts of methacrylic acid, 184.0 parts of n-butyl acrylate and 1.0 part of ammonium persulfate were loaded into a reactor with an attached stirring bar and thermometer, and stirred at 400 rpm for 15 minutes to obtain a white suspension. This was heated to raise the temperature inside the system to 75° C., and a reaction was performed for 5 hours.

A further 30.0 parts of a 1% ammonium persulfate aqueous solution were added, and this was cured for 5 hours at 75° C. to obtain a vinyl polymer fine particle dispersion 1. The volume-based particle diameter of the fine particle dispersion 1 was 0.15 μm.

Preparation of Colorant Dispersion

| | |
|---|---|
| C.I. pigment blue 15:3 | 100.0 parts |
| Ethyl acetate | 150.0 parts |
| Glass beads (1 mm) | 200.0 parts |

These materials were placed in a heat-resistant glass vessel, and dispersed for 5 hours with a pain shaker, and the glass beads were removed with a nylon mesh to obtain a colorant dispersion 1.

Preparation of Wax Dispersion 1

| | |
|---|---|
| Paraffin wax (Nippon Seiro HNP-51) | 20.0 parts |
| Ethyl acetate | 80.0 parts |

These were placed in a sealable reactor, and heated and stirred at 80° C. The inside of the system was then cooled to 25° C. over the course of 3 hours under gentle stirring at 50 rpm to obtain a milky white liquid.

This solution was placed in a heat-resistant vessel together with 30.0 mass parts of glass beads 1 mm in diameter and dispersed for 3 hours with a paint shaker (Toyo Seiki), and the glass beads were removed with a nylon mesh to obtain a wax dispersion 1.

Preparation of Oil Phase 1

| | |
|---|---|
| Polymer 1 | 100.0 parts |
| Ethyl acetate | 85.0 parts |

These materials were placed in a beaker, and stirred for 1 minute at 3,000 rpm with a Disper (Tokushu Kika).

| | |
|---|---|
| Wax dispersion 1 (solids 20%) | 50.0 parts |
| Colorant dispersion 1 (solids 40%) | 12.5 parts |
| Ethyl acetate | 5.0 parts |

These materials were then added to the beaker, and stirred for 3 minutes at 6,000 rpm with a Disper (Tokushu Kika) to prepare an oil phase 1.

Preparation of Water Phase 1

| | |
|---|---|
| Fine particle dispersion 1 | 15.0 parts |
| Dodecyl diphenyl ether sodium disulfonate aqueous solution (Eleminol MON7, Sanyo Chemical Industries) | 30.0 parts |
| Ion-exchanged water | 955.0 parts |

These materials were placed in a beaker, and stirred for 3 minutes at 3,000 rpm with a Disper (Tokushu Kika) to prepare a water phase 1.

Manufacture of Toner Particle

The oil phase was added to the water phase, and dispersed for 10 minutes at 10,000 rpm with a TK Homogenizer (Tokushu Kika). The solvent was then removed for 30 minutes at 30° C. under reduced pressure of 50 mmHg. This was then filtered, and the operations of filtration and re-dispersal in ion-exchanged water were repeated until the conductivity of the slurry was 100 μS, to remove the surfactant and obtain a filtrate cake.

This filtrate cake was vacuum dried, and then air classified to obtain a toner particle 3.

Toner Particle Manufacturing Example 4

| | |
|---|---|
| Polymer 1 | 100 parts |
| Aliphatic hydrocarbon compound HNP-51 (Nippon Seiro) | 10 parts |
| C.I. pigment blue 15:3 | 6.5 parts |
| Aluminum 3,5-di-t-butyl salicylate compound | 0.5 parts |

These materials were mixed at a rotation speed of 20 $s^{-1}$ for a rotation time of 5 min in a Henschel Mixer (FM-75, Nippon Coke & Engineering), and then kneaded at a discharge temperature of 135° C. in a twin-screw kneader (PCM-30, Ikegai Corp.) set to 120° C. The resulting kneaded product was cooled at a cooling speed of 15° C./min, and coarsely pulverized to 1 mm or less in a hammer mill to obtain a coarsely pulverized product. The coarsely pulverized product was then finely pulverized in a mechanical pulverizer (Freund Turbo T-250).

This was then classified with a Faculty F-300 (Hosokawa Micron) to obtain a toner particle 4. The operating conditions were a classifying rotor rotation of 130 $s^{-1}$ and a dispersing rotor rotation of 120 $s^{-1}$.

Toner Manufacturing Example 1

| | |
|---|---|
| Toner particle 1 | 100 parts |
| Strontium titanate fine particle 1 | 0.5 parts |

These materials were mixed at a rotation speed of 30 $s^{-1}$ for a rotation time of 10 minutes in an FM-10C Henschel mixer (Mitsui Miike) to obtain a toner 1. The constituent materials of the toner 1 are shown in Table 8.

The toner 1 had a weight-average particle diameter (D4) of 6.1 μm. The physical properties of the toner 1 are shown in Table 9.

Manufacturing Examples of Toner Particles 5 to 32

Toner particles 5 to 32 were obtained as in the manufacturing example of the toner particle 1 except that the formulation of the polymer 1 was changed as shown in Table 7. In the case of toner particles 24 and 25, the dispersion of the polymer fine particle 1 and the dispersion of the amorphous resin fine particle 1 other than the polymer A were mixed in the amounts shown in Table 7.

Toner Manufacturing Examples 2 to 55

Toners 2 to 55 were manufactured as in the toner manufacturing example 1 except that the toner particles and inorganic fine particles were changed as shown in Table 7.

The physical properties of the resulting toners 2 to 55 are shown in Table 8.

TABLE 8

| Toner No. | Particle diameter μm | Coverage ratio % | Charge decay rate coefficient α | Cx/Cy |
|---|---|---|---|---|
| 1 | 6.1 | 20 | 4 | 1.2 |
| 2 | 6.1 | 20 | 4 | 1.2 |
| 3 | 6.1 | 20 | 4 | 1.2 |
| 4 | 6.1 | 20 | 4 | 1.2 |
| 5 | 6.1 | 16 | 8 | 1.2 |
| 6 | 6.1 | 24 | 12 | 1.2 |
| 7 | 6.1 | 20 | 10 | 1.2 |
| 8 | 6.1 | 20 | 10 | 1.2 |
| 9 | 6.1 | 20 | 10 | 1.8 |
| 10 | 6.1 | 20 | 10 | 2.8 |
| 11 | 6.1 | 20 | 10 | 1.0 |
| 12 | 6.1 | 20 | 10 | 1.2 |
| 13 | 6.1 | 20 | 10 | 2.8 |
| 14 | 6.1 | 20 | 24 | 5.5 |
| 15 | 6.1 | 20 | 30 | 0.9 |
| 16 | 6.1 | 20 | 36 | 5.5 |
| 17 | 6.1 | 20 | 66 | 0.8 |
| 18 | 6.1 | 20 | 72 | 7.3 |
| 19 | 6.1 | 12 | 72 | 7.3 |
| 20 | 6.1 | 40 | 72 | 7.3 |
| 21 | 6.1 | 75 | 72 | 7.3 |
| 22 | 6.1 | 6 | 30 | 7.3 |
| 23 | 6.1 | 6 | 30 | 7.3 |
| 24 | 6.1 | 6 | 30 | 7.3 |
| 25 | 6.1 | 6 | 40 | 7.3 |
| 26 | 6.1 | 6 | 32 | 7.3 |
| 27 | 6.1 | 6 | 32 | 7.3 |
| 28 | 6.1 | 6 | 32 | 7.3 |
| 29 | 6.1 | 6 | 32 | 7.3 |
| 30 | 6.1 | 6 | 70 | 7.3 |
| 31 | 6.1 | 6 | 27 | 7.3 |
| 32 | 6.1 | 6 | 60 | 7.3 |
| 33 | 6.1 | 6 | 25 | 7.3 |
| 34 | 6.1 | 6 | 25 | 7.3 |
| 35 | 6.1 | 6 | 25 | 7.3 |
| 36 | 6.1 | 6 | 25 | 6.0 |
| 37 | 6.1 | 6 | 25 | 10.0 |
| 38 | 6.1 | 6 | 25 | 9.3 |
| 39 | 6.1 | 6 | 25 | 7.3 |
| 40 | 6.1 | 6 | 25 | 7.3 |
| 41 | 6.1 | 6 | 25 | 6.9 |
| 42 | 6.1 | 6 | 25 | 7.3 |
| 43 | 6.1 | 6 | 25 | 7.3 |
| 44 | 6.1 | 6 | 80 | 7.3 |
| 45 | 6.1 | 6 | 84 | 7.3 |
| 46 | 6.1 | 6 | 20 | 7.3 |
| 47 | 6.1 | 6 | 24 | 7.3 |
| 48 | 6.1 | 6 | 26 | 7.3 |
| 49 | 6.1 | 6 | 28 | 7.3 |
| 50 | 6.1 | 6 | 35 | 5.3 |
| 51 | 6.1 | 6 | 200 | 7.3 |
| 52 | 6.1 | 6 | 78 | 7.3 |
| 53 | 6.1 | 6 | 180 | 7.3 |
| 54 | 6.1 | 6 | 6 | 7.3 |
| 55 | 6.1 | 6 | 35 | 7.3 |

Manufacturing Example of Magnetic Carrier 1

Magnetite with number-average particle diameter of 0.30 μm (magnetization strength 65 $Am^2/kg$ in 1000/4π (kA/m) magnetic field)

Magnetite with number-average particle diameter of 0.50 μm (magnetization strength 65 $Am^2/kg$ in 1000/4π (kA/m) magnetic field)

4.0 parts of a silane compound (3-(2-aminoethylamino-propyl)trimethoxysilane) were added to 100 parts each of the above materials, and mixed and stirred at high speed at 100° C. or more in a vessel to treat the respective fine particles.

Phenol: 10 mass %

Formaldehyde solution: 6 mass % (formaldehyde 40 mass %, methanol 10 mass %, water 50 mass %)

Magnetite treated with silane compound: 58 mass %

Magnetite treated with silane compound: 26 mass %

100 parts of these materials, 5 parts of 28 mass % aqueous ammonia solution and 20 parts of water were placed in a flask, and stirred and mixed as the temperature was raised to 85° C. for 30 minutes, and maintained for 3 hours to perform a polymerization reaction, and the resulting phenol resin was hardened. The hardened phenol resin was then cooled to 30° C., water was added, the supernatant was removed, and the precipitate was water washed and air dried. This was then dried at 60° C. under reduced pressure (5 mmHg or less) to obtain a magnetic dispersion-type spherical magnetic carrier. The volume-based 50% particle diameter (D50) was 34.2 μm.

Manufacturing Example of Two-Component Developer 1

8.0 parts of the toner 1 were added to 92.0 parts of the magnetic carrier 1, and mixed with a V-type mixer (Seishin Corp. V-20) to obtain a two-component developer 1.

Manufacturing Examples of Two-Component Developers 2 to 55

Two-component developers 2 to 55 were manufactured as in the manufacturing example of the two-component developer 1 except that the toner were changed as shown in Table 9.

TABLE 9

| Two-component developer | Toner No. | Carrier |
|---|---|---|
| Two-component developer 1 | Toner 1 | Magnetic carrier 1 |
| Two-component developer 2 | Toner 2 | Magnetic carrier 1 |
| Two-component developer 3 | Toner 3 | Magnetic carrier 1 |
| Two-component developer 4 | Toner 4 | Magnetic carrier 1 |
| Two-component developer 5 | Toner 5 | Magnetic carrier 1 |
| Two-component developer 6 | Toner 6 | Magnetic carrier 1 |
| Two-component developer 7 | Toner 7 | Magnetic carrier 1 |
| Two-component developer 8 | Toner 8 | Magnetic carrier 1 |
| Two-component developer 9 | Toner 9 | Magnetic carrier 1 |
| Two-component developer 10 | Toner 10 | Magnetic carrier 1 |
| Two-component developer 11 | Toner 11 | Magnetic carrier 1 |
| Two-component developer 12 | Toner 12 | Magnetic carrier 1 |
| Two-component developer 13 | Toner 13 | Magnetic carrier 1 |
| Two-component developer 14 | Toner 14 | Magnetic carrier 1 |
| Two-component developer 15 | Toner 15 | Magnetic carrier 1 |
| Two-component developer 16 | Toner 16 | Magnetic carrier 1 |
| Two-component developer 17 | Toner 17 | Magnetic carrier 1 |
| Two-component developer 18 | Toner 18 | Magnetic carrier 1 |
| Two-component developer 19 | Toner 19 | Magnetic carrier 1 |
| Two-component developer 20 | Toner 20 | Magnetic carrier 1 |
| Two-component developer 21 | Toner 21 | Magnetic carrier 1 |
| Two-component developer 22 | Toner 22 | Magnetic carrier 1 |
| Two-component developer 23 | Toner 23 | Magnetic carrier 1 |
| Two-component developer 24 | Toner 24 | Magnetic carrier 1 |
| Two-component developer 25 | Toner 25 | Magnetic carrier 1 |
| Two-component developer 26 | Toner 26 | Magnetic carrier 1 |
| Two-component developer 27 | Toner 27 | Magnetic carrier 1 |
| Two-component developer 28 | Toner 28 | Magnetic carrier 1 |
| Two-component developer 29 | Toner 29 | Magnetic carrier 1 |
| Two-component developer 30 | Toner 30 | Magnetic carrier 1 |
| Two-component developer 31 | Toner 31 | Magnetic carrier 1 |
| Two-component developer 32 | Toner 32 | Magnetic carrier 1 |
| Two-component developer 33 | Toner 33 | Magnetic carrier 1 |
| Two-component developer 34 | Toner 34 | Magnetic carrier 1 |
| Two-component developer 35 | Toner 35 | Magnetic carrier 1 |
| Two-component developer 36 | Toner 36 | Magnetic carrier 1 |
| Two-component developer 37 | Toner 37 | Magnetic carrier 1 |
| Two-component developer 38 | Toner 38 | Magnetic carrier 1 |
| Two-component developer 39 | Toner 39 | Magnetic carrier 1 |
| Two-component developer 40 | Toner 40 | Magnetic carrier 1 |
| Two-component developer 41 | Toner 41 | Magnetic carrier 1 |

TABLE 9-continued

| Two-component developer | Toner No. | Carrier |
|---|---|---|
| Two-component developer 42 | Toner 42 | Magnetic carrier 1 |
| Two-component developer 43 | Toner 43 | Magnetic carrier 1 |
| Two-component developer 44 | Toner 44 | Magnetic carrier 1 |
| Two-component developer 45 | Toner 45 | Magnetic carrier 1 |
| Two-component developer 46 | Toner 46 | Magnetic carrier 1 |
| Two-component developer 47 | Toner 47 | Magnetic carrier 1 |
| Two-component developer 48 | Toner 48 | Magnetic carrier 1 |
| Two-component developer 49 | Toner 49 | Magnetic carrier 1 |
| Two-component developer 50 | Toner 50 | Magnetic carrier 1 |
| Two-component developer 51 | Toner 51 | Magnetic carrier 1 |
| Two-component developer 52 | Toner 52 | Magnetic carrier 1 |
| Two-component developer 53 | Toner 53 | Magnetic carrier 1 |
| Two-component developer 54 | Toner 54 | Magnetic carrier 1 |
| Two-component developer 55 | Toner 55 | Magnetic carrier 1 |

Evaluation of Charge Rising Performance

Charge rising performance is evaluated by measuring the density change when images with different image printing ratios and densities are output. An image with a low image ratio is output to saturate the charge of the toner in the developing unit, and an image with a high image ratio is output. A density change occurs as a result due to the difference in charge between the charge-saturated toner already in the developing unit and the new toner supplied to the developing unit.

Because toner with rapid charge rising becomes rapidly saturated with charge after being supplied to the developing unit, there is little density change. On the other hand, a toner with slow charge rising takes time to become saturated with charge after being supplied to the developing unit, lowering the charge quantity of the toner as a whole and changing the density.

Using a Canon imagePress C800 full-color copier as the image-forming apparatus, two-component developer to be evaluated was placed in the cyan developing device of the image-forming apparatus, and toner to be evaluated was placed in a cyan toner container and evaluated as follows.

As modifications, the mechanism for removing excess magnetic carrier from inside the developing device was removed. Ordinary GF-C081 paper (A4, basis weight 81.4 g/m$^2$, Canon Marketing Japan) was used as the evaluation paper.

The laid-on level of the toner on the paper in an FFh image (solid image) was adjusted to 0.45 mg/cm$^2$. FFh is a value obtained by displaying 256 tones in hexadecimal notation, with 00h being the first of 256 tones (white background), and FF being the 256th tone (solid part).

An image output test was performed by outputting 1,000 prints with an image ratio of 1%. During 1,000 sheets of continuous paper feed, the developing conditions and transfer conditions (without calibration) were the same as for the first print.

An image output test was then performed by outputting 1,000 prints at an image ratio of 80%. During 1,000 sheets of continuous paper feed, the developing conditions and transfer conditions (without calibration) were the same as for the first print.

The image density of the 1000th print in printing at an image ratio of 1% was taken as the initial density. The density of the 1000th image in printing at an image ratio of 80% was measured, and was evaluated according to the following evaluation criteria. The evaluation results are shown in a table.

This test was performed in a normal-temperature, normal-humidity environment (N/N; 23° C., RH 50%), and in a normal-temperature, low humidity environment (N/L; 23° C., RH 5%)

(1) Measuring Image Density Change

Using an X-rite color reflection densitometer (500 series; X-Rite), the initial density and the density of the 1,000th image printed with an image ratio of 80% were measured, and ranked according to the following standard. The evaluation results are shown in Table 8. A rank of C or greater indicates that the effects of the invention have been obtained.

Density Difference

A: Less than 0.02

BB: not less than 0.02 and less than 0.04

B: not less than 0.04 and less than 0.06

C: not less than 0.06 and less than 0.10

D: 0.10 or greater

Charge Retention in High-temperature, High-humidity Environment

The toner on the electrostatic latent image bearing member was collected by suction with a metal cylindrical tube and a cylindrical filter to measure the triboelectric charge quantity of the toner.

Specifically, the triboelectric charge quantity of the toner on the electrostatic latent image bearing member was measured with a Faraday cage. A Faraday cage is a coaxial double cylinder in which the inner and outer cylinder are insulated from each other. If a charged body with a charge quantity Q is placed in the inner cylinder, electrostatic induction makes it as though there is a metal cylinder with a charge quantity Q. This induced charge quantity is measured with an electrometer (Keithley 6517A, Keithley), and the charge quantity Q (mC) is divided by the toner mass M (kg) in the inner cylinder (Q/M), and regarded as the triboelectric charge quantity of the toner.

$$\text{Toner triboelectric charge quantity (mC/kg)} = Q/MI$$

The image for evaluation was first formed on the electrostatic latent image bearing member, and before it could be transferred to the intermediate transfer member, the rotation of the electrostatic latent image bearing member was stopped, and the toner on the electrostatic latent image bearing member was collected by suction with a metal cylindrical tube and a cylindrical filter, and "initial Q/M" was measured.

Next, the evaluation unit was left standing for two weeks with the developing device still installed in a high-temperature, high-humidity environment (HI/H, 30° C., 80% RH), the same operations were performed as before, and the charge quantity Q/M (mC/kg) per unit mass on the electrostatic latent image bearing member after standing was measured. The initial Q/M per unit mass on the electrostatic latent image bearing member is taken as 100%, the retention rate of Q/M per unit mass on the electrostatic latent image bear member after standing ([Q/M after standing]/[initial Q/M]×100) was calculated and evaluated according to the following standard. A rank of C or greater indicates that the effects of the invention have been obtained.

Evaluation Standard

A: Retention rate not less than 95%

B: Retention rate not less than 90% and less than 95%

BB: Retention rate not less than 85% and less than 90%

C: Retention rate not less than 80% and less than 85%

D: Retention rate less than 80%

Evaluating Low-Temperature Fixability of Toner

Paper: GFC-081 (81.0 g/m$^2$) (Canon Marketing Japan)

Toner laid-on level on paper: 0.50 mg/cm$^2$ (Adjusted by DC voltage VDC of developer carrying member, charging voltage VD of electrostatic latent image bearing member, and laser power)

Evaluation image: 2 cm×5 cm image positioned in center of above A4 paper

Test environment: Low-temperature low-humidity environment: 15° C./10% RH (hereunder "L/L")

Fixing temperature: 130° C.

Process speed: 377 mm/sec

This evaluation image was output, and low-temperature fixability was evaluated. The rate of decrease in image density was taken as an indicator of low-temperature fixability. The image density decrease rate was evaluated by first measuring the image density of the central part with an X-rite color reflection densitometer (500 Series: X-Rite). Next, the fixed image was rubbed (5 times back and forth) with Silbon paper under a load of 4.9 kPa (50 g/cm$^{2)}$ on the part where image density was measured, and image density was measured again. The image density decrease rate after rubbing was then calculated according to the following formula. The resulting image density decrease rate was evaluated according to the following standard. A rank of C or greater indicates that the effects of the invention have been obtained.

Image density decrease rate=(image density before rubbing−image density after rubbing)/image density before rubbing×100

Evaluation Standard

A: Image density decrease rate less than 3.0%

B: Image density decrease rate not less than 3.0% and less than 5.0%

C: Image density decrease rate not less than 5.0% and less than 150%

D: Image density decrease rate not less than 15.0%

Toner Blocking (Heat-Resistant Storage Stability)

Blocking resistance was evaluated to evaluate stability during storage. About 5 g of toner was placed in a 100 mL resin cup, and left for 10 days at 50° C., 20% RH, and the degree of aggregation of the toner was measured as follows and evaluated according to the following standard.

For the measurement unit, a digital display vibration meter (Digivibro Model 1332A, Showa Sokki) was connected to the shaking table side part of a Powder Tester (Hosokawa Micron). A 38 μm (400 mesh) screen, a 75 μm (200 mesh) screen and a 150 μm (100 mesh) screen were then set on the Powder Tester shaking table in that order from bottom to top. Measurement was performed as follows at 23° C., 60% RH.

(1) The vibration width of the shaking table was adjusted in advance so that the displacement value of the digital display vibration meter was 0.60 mm (peak-to-peak).

(2) Toner that had been left for 10 days as described above was left for 24 hours in advance in a 23° C., 60% RH environment, and 5 g of this toner was weighed exactly and placed gently on the upper 150 μm screen.

(3) The screens were vibrated for 15 seconds, the mass of the toner remaining on each screen was measured, and aggregation was calculated based on the following formula. The evaluation results are shown in Table 7.

Aggregation (%)={(sample mass (g) on 150 μm screen)/5 (g)}×100+{(sample mass (g) on 75 μm screen)/5 (g)}×100×0.6+{(sample mass (g) on 38 μm screen)/5 (g)}×100×0.2

The evaluation standard is as follows.

A: Aggregation less than 20%

B: Aggregation not less than 20% and less than 25%

C: Aggregation not less than 25% and less than 35%

D: Aggregation not less than 35%

A rank of C or greater indicates that the effects of the invention have been obtained.

TABLE 10

| Example | Two-component developer | Low-temperature fixability | NN rising | | NL rising | | HH charge decrease rate | | Blocking |
|---|---|---|---|---|---|---|---|---|---|
| No. | No. | Rank | Δ | Rank | Δ | Rank | % | Rank | Rank |
| 1 | 1 | A | 0.01 | A | 0.01 | A | 97 | A | A |
| 2 | 2 | A | 0.01 | A | 0.01 | A | 97 | A | A |
| 3 | 3 | A | 0.01 | A | 0.01 | A | 97 | A | A |
| 4 | 4 | A | 0.01 | A | 0.01 | A | 97 | A | A |
| 5 | 5 | A | 0.01 | A | 0.02 | BB | 97 | A | A |
| 6 | 6 | A | 0.01 | A | 0.02 | BB | 97 | A | A |
| 7 | 7 | A | 0.01 | A | 0.02 | BB | 97 | A | A |
| 8 | 8 | A | 0.01 | A | 0.02 | BB | 97 | A | A |
| 9 | 9 | A | 0.01 | A | 0.02 | BB | 97 | A | A |
| 10 | 10 | A | 0.01 | A | 0.02 | BB | 97 | A | A |
| 11 | 11 | A | 0.01 | A | 0.02 | BB | 97 | A | A |
| 12 | 12 | A | 0.01 | A | 0.02 | BB | 97 | A | A |
| 13 | 13 | A | 0.01 | A | 0.02 | BB | 97 | A | A |
| 14 | 14 | A | 0.01 | A | 0.02 | BB | 97 | A | A |
| 15 | 15 | A | 0.02 | BB | 0.03 | BB | 92 | BB | A |
| 16 | 16 | A | 0.02 | BB | 0.03 | BB | 92 | BB | A |
| 17 | 17 | A | 0.03 | BB | 0.05 | B | 92 | BB | A |
| 18 | 18 | A | 0.03 | BB | 0.06 | B | 92 | BB | A |
| 19 | 19 | A | 0.03 | BB | 0.05 | B | 92 | BB | A |
| 20 | 20 | A | 0.01 | A | 0.03 | BB | 92 | BB | A |
| 21 | 21 | A | 0.01 | A | 0.03 | BB | 92 | BB | A |
| 22 | 22 | A | 0.04 | B | 0.05 | B | 88 | B | A |
| 23 | 23 | A | 0.04 | B | 0.05 | B | 86 | B | A |
| 24 | 24 | A | 0.04 | B | 0.05 | B | 86 | B | B |
| 25 | 25 | B | 0.04 | B | 0.05 | B | 83 | C | B |
| 26 | 26 | C | 0.04 | B | 0.05 | B | 88 | B | C |
| 27 | 27 | C | 0.04 | B | 0.05 | B | 88 | B | C |
| 28 | 28 | A | 0.04 | B | 0.08 | C | 88 | B | B |
| 29 | 29 | A | 0.06 | C | 0.06 | C | 88 | B | B |
| 30 | 30 | A | 0.08 | C | 0.08 | C | 82 | C | C |
| 31 | 31 | A | 0.04 | B | 0.08 | C | 87 | B | A |

TABLE 10-continued

| Example | Two-component developer | Low-temperature fixability | NN rising | | NL rising | | HH charge decrease rate | | Blocking |
|---|---|---|---|---|---|---|---|---|---|
| No. | No. | Rank | Δ | Rank | Δ | Rank | % | Rank | Rank |
| 32 | 32 | C | 0.04 | B | 0.05 | B | 81 | C | B |
| 33 | 33 | C | 0.04 | B | 0.05 | B | 88 | B | C |
| 34 | 34 | A | 0.04 | B | 0.08 | C | 88 | B | B |
| 35 | 35 | C | 0.08 | C | 0.09 | C | 88 | B | C |
| 36 | 36 | A | 0.04 | B | 0.05 | B | 88 | B | C |
| 37 | 37 | C | 0.04 | B | 0.05 | B | 88 | B | A |
| 38 | 38 | C | 0.04 | B | 0.05 | B | 88 | B | A |
| 39 | 39 | A | 0.04 | B | 0.05 | B | 88 | B | B |
| 40 | 40 | A | 0.04 | B | 0.05 | B | 88 | B | A |
| 41 | 41 | A | 0.04 | B | 0.05 | B | 88 | B | B |
| 42 | 42 | A | 0.05 | B | 0.07 | C | 88 | B | A |
| 43 | 43 | A | 0.09 | C | 0.09 | C | 88 | B | A |
| 44 | 44 | A | 0.04 | B | 0.05 | B | 87 | B | A |
| 45 | 45 | A | 0.04 | B | 0.05 | B | 81 | C | A |
| 46 | 46 | A | 0.04 | B | 0.08 | C | 89 | B | A |
| 47 | 55 | C | 0.06 | C | 0.06 | C | 88 | B | B |
| C.E.1 | 47 | A | 0.07 | C | 0.14 | D | 88 | B | C |
| C.E.2 | 48 | A | 0.06 | C | 0.12 | D | 86 | B | A |
| C.E.3 | 49 | A | 0.09 | C | 0.12 | D | 86 | B | C |
| C.E.4 | 50 | A | 0.05 | B | 0.05 | B | 76 | D | D |
| C.E.5 | 51 | A | 0.11 | D | 0.11 | D | 78 | D | D |
| C.E.6 | 52 | A | 0.11 | D | 0.15 | D | 80 | C | A |
| C.E.7 | 53 | A | 0.04 | B | 0.05 | B | 60 | D | A |
| C.E.8 | 54 | A | 0.15 | D | 0.18 | D | 90 | B | A |

In the table, C.E. denotes "comparative Example".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-113140, filed Jun. 13, 2018, and Japanese Patent Application No. 2019-074932, filed Apr. 10, 2019, which are hereby incorporated by reference herein in their entirety.

What is claimed is:

1. A toner, comprising:

an inorganic fine particle that is surface treated with a compound having an alkyl group, the inorganic fine particle having a volume resistivity of $1.0\times10^5$ to $1.0\times10^{13}$ Ω·cm; and a toner particle containing a binder resin, the binder resin containing a polymer A that is obtained by polymerizing a polymerizable monomer in a monomer composition containing a first polymerizable monomer that is at least one member selected from the group consisting of (meth)acrylic acid esters each having an alkyl group including a carbon number of 18 to 36, a second polymerizable monomer that is different from the first polymerizable monomer and having an ethylenically unsaturated bond, and a third polymerizable monomer that is different from the first and second polymerizable monomers, the third polymerizable monomer being at least one member selected from the group consisting of styrene, methyl methacrylate and methyl acrylate, wherein the content of the first polymerizable monomer in the monomer composition is 5.0 to 60.0 mol % of the total moles of all polymerizable monomers in the monomer composition, the content of the second polymerizable monomer in the monomer composition is 20.0 to 95.0 mol % of the total moles of all polymerizable monomers in the monomer composition, and $0.60 \leq (SP_{22} - SP_{12}) \leq 15.00$ and $18.30 \leq SP_{22}$ are satisfied where $SP_{12}$ $(J/cm^3)^{0.5}$ is the SP value of the first polymerizable monomer and $SP_{22}$ $(J/cm^3)^{0.5}$ is the SP value of the second polymerizable monomer.

2. The toner according to claim 1, wherein the content of the second polymerizable monomer in the composition is 40.0 to 95.0 mol % of the total moles of all polymerizable monomers in the composition.

3. The toner according to claim 1, wherein the inorganic fine particle is strontium titanate having a perovskite crystal structure.

4. A toner, comprising:

an inorganic fine particle that is surface treated with a compound having an alkyl group, the inorganic fine powder having a volume resistivity of $1.0\times10^5$ to $1.0\times10^{13}$ Ω·cm; and a toner particle containing a binder resin, the binder resin containing a polymer A that is a polymer obtained by polymerizing a polymerizable monomer in a monomer composition containing a first polymerizable monomer and a second polymerizable monomer that is different from the first polymerizable monomer, the content of polymer A being at least 50 mass % based on the total mass of the binder resin;

the first polymerizable monomer is at least one member selected from the group consisting of (meth)acrylic acid esters each having an alkyl group including a carbon number of 18 to 36; and the second polymerizable monomer having an ethylenically unsaturated bond, wherein the content of the first polymerizable monomer in the monomer composition is 5.0 to 60.0 mol % of the total moles of all polymerizable monomers in the monomer composition, the content of the second polymerizable monomer in the monomer composition is 20.0 to 95.0 mol % of the total moles of all polymerizable monomers in the monomer composition, and $0.60 \leq (SP_{22}-SP_{12}) \leq 15.00$ and $18.30 \leq SP_{22}$ are satisfied, where $SP_{12}$ $(J/cm^3)^{0.5}$ is the SP value of the first polymerizable monomer and $SP_{22}$ $(J/cm^3)^{0.5}$ is the SP value of the second polymerizable monomer.

* * * * *